US009568233B2

(12) United States Patent
Liao et al.

(10) Patent No.: US 9,568,233 B2
(45) Date of Patent: Feb. 14, 2017

(54) SHAVE ICE DEVICE AND METHOD OF USE THEREOF

(71) Applicant: FROSTALICIOUS, LLC, Santa Monica, CA (US)

(72) Inventors: Ellen Li Liao, Los Angeles, CA (US); Yu Li Liao, Los Angeles, CA (US); Hao-Wen Liu, Taichung (TW)

(73) Assignee: FROSTALICIOUS, LLC, Los Angeles, CA (US)

( * ) Notice: Subject to any disclaimer, the term of this patent is extended or adjusted under 35 U.S.C. 154(b) by 213 days.

(21) Appl. No.: 14/271,180

(22) Filed: May 6, 2014

(65) Prior Publication Data

US 2014/0332612 A1 Nov. 13, 2014

Related U.S. Application Data

(60) Provisional application No. 61/880,679, filed on Sep. 20, 2013, provisional application No. 61/838,175, filed on Jun. 21, 2013.

(30) Foreign Application Priority Data

May 7, 2013 (TW) ..... 102208422 U

(51) Int. Cl.
*B02C 23/00* (2006.01)
*F25C 5/12* (2006.01)
*F25C 5/02* (2006.01)

(52) U.S. Cl.
CPC . *F25C 5/12* (2013.01); *F25C 5/02* (2013.01); *B02C 23/00* (2013.01)

(58) Field of Classification Search
CPC ..... F25C 5/12; F25C 5/02; B02C 18/16; B02C 2018/0046; B02C 13/282; B02C 23/00; Y10S 241/17
USPC ..... 241/DIG. 17, 95, 99, 285.2
See application file for complete search history.

(56) References Cited

U.S. PATENT DOCUMENTS 3,515,357 A * 6/1970 Clark ..... B67B 7/38 241/101.2
3,791,597 A * 2/1974 Walter ..... A47J 43/042 241/100
4,569,266 A * 2/1986 Ando ..... A23G 9/045 241/101.2
4,588,136 A * 5/1986 Homma ..... A23G 9/045 241/168

(Continued)

FOREIGN PATENT DOCUMENTS

JP 2008-281322 A 11/2008

OTHER PUBLICATIONS

International Search Report and Written Opinion mailed Mar. 4, 2015 for corresponding International Application No. PCT/US14/37060.

*Primary Examiner* — Faye Francis
(74) *Attorney, Agent, or Firm* — Arent Fox LLP

(57) ABSTRACT

A shave ice device having a first compartment, a second compartment below the first compartment, a gripping mechanism for gripping a block of ice, a rotating mechanism for rotating the gripping mechanism, a shaving plate separating the first compartment from the second compartment, and a cooling mechanism in communication with the first compartment. The cooling mechanism maintains the temperature of the first compartment at about 0 degrees Celsius or lower.

20 Claims, 11 Drawing Sheets

(56) References Cited

U.S. PATENT DOCUMENTS

| | | | | | |
|---|---|---|---|---|---|
| 4,718,610 | A * | 1/1988 | Gallaher | A23G 9/045 | 241/101.2 |
| 4,828,395 | A * | 5/1989 | Saito | C12M 47/06 | 241/2 |
| 5,402,949 | A * | 4/1995 | Berner | A23G 9/045 | 241/101.2 |
| 5,513,810 | A * | 5/1996 | Lin | B26D 3/225 | 241/168 |
| 5,680,771 | A | 10/1997 | Yoo et al. | | |
| 6,012,660 | A * | 1/2000 | Colman | F25C 5/12 | 241/100 |
| 6,328,236 | B1 * | 12/2001 | Upson | F25C 5/12 | 241/95 |
| 6,908,053 | B2 * | 6/2005 | Rupp | A23G 9/045 | 241/86.1 |
| 7,111,473 | B2 * | 9/2006 | Chung | F25C 5/007 | 241/DIG. 17 |
| 7,207,506 | B1 * | 4/2007 | Dickson, Jr. | A23G 9/045 | 241/21 |
| 7,278,275 | B2 * | 10/2007 | Voglewede | F25C 5/005 | 241/DIG. 17 |
| 8,807,469 | B2 * | 8/2014 | Sung | A47J 43/255 | 241/285.2 |
| 2004/0021020 | A1 | 2/2004 | Rupp | | |
| 2005/0126201 | A1 | 6/2005 | Navedo et al. | | |
| 2006/0070386 | A1 | 4/2006 | An | | |
| 2006/0207270 | A1 | 9/2006 | Voglewede et al. | | |
| 2010/0037786 | A1 | 2/2010 | Kounlavong et al. | | |
| 2012/0277906 | A1 | 11/2012 | Fassberg et al. | | |

* cited by examiner

SHAVE ICE DEVICE AND METHOD OF USE THEREOF

CROSS REFERENCE TO RELATED APPLICATIONS

This application claims priority to Taiwan Application No. 102208422, filed on May 7, 2013, U.S. Provisional Application No. 61/838,175, titled "FREEZER WITH SHAVING CAPABILITY," filed on Jun. 21, 2013, and U.S. Provisional Application No. 61/880,679, titled "SHAVE ICE DEVICE AND METHOD OF USE THEREOF," filed on Sep. 20, 2013, the entirety of each is hereby expressly incorporated by reference herein.

FIELD THE INVENTION

Aspects of the present invention relate to shave ice devices, specifically self-service shave ice devices.

BACKGROUND OF THE INVENTION

Known shave ice devices are typically operated by an owner/facility operator specially trained to operate the shave ice device. To operate a conventional shave ice device, the owner/facility operator must first remove a block of ice from a freezer. Next, the owner/facility operator directly mounts the ice by hand onto a supporting structure within the device. The owner/facility operator then operates the device which rotates the block of ice along a cutting element. As the ice block rotates around the cutting element, the shaved ice drops onto a receiving plate. The owner/facility operator typically has to rotate the plate and/or readjust the position of the ice block to provide a proper distribution of shaved ice. During shaving, in the conventional devices, the compartment containing the ice block is open to allow the operator to manipulate the ice block. Thus, during shaving, some of the ice may be expelled outwardly toward the owner/facility operator in addition to downwardly onto the receiving plate. After shaving the ice, the owner/facility operator manually returns the ice back into the freezer. The owner/facility operator adds flavoring to the shaved ice as requested by the customer, then gives the customer the flavored shave ice product. The owner/facility operator repeats the above steps every time a customer orders a shave ice, including mounting and returning the ice block to the freezer.

The above operation has several drawbacks. First, it requires a specially trained operator to provide a customer with the shave ice product. Second, because the ice block is handled by the operator every time a shave ice is ordered, there is substantial risk of contamination. Third, because of the open ice block compartment, ice debris can easily spray onto the surrounding area during shaving. Fourth, moving the ice back and forth between the device and the freezer is inefficient. The ice block shaves the best at about −20 degrees Celsius. Thus, as soon as the ice is removed from the freezer into the ambient room temperature to be mounted onto the ice shaver, the quality of the shaved ice starts to deteriorate. This problem is magnified by high volume businesses where the operator must move the ice block between the freezer and device many times through the day. Thus, the process of removing the ice block from the freezer and mounting it onto the device can be time consuming, labor intensive, and unsanitary.

Furthermore, the conventional device and operation method causes a problem in customer satisfaction. Consumers are well aware of cleanliness in food preparation. When a customer observers the operator repeatedly handling the same ice block multiple times before being served, the customer may no longer want to ingest the product. Accordingly, the conventional device and method may often lead to loss of potential customers.

For the above reasons, there is a need in the art for a customer-operable/self-service shave ice device that avoids the above-described disadvantages.

SUMMARY OF THE INVENTION

Aspects of the present invention include a shave ice device having a first compartment, a second compartment below the first compartment, a gripping mechanism for gripping a block of ice, a rotating mechanism for rotating the gripping mechanism, a shaving plate separating the first compartment from the second compartment; and a cooling mechanism in communication with the first compartment, wherein the cooling mechanism maintains the temperature of the first compartment at about 0 degrees Celsius or lower.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 1:
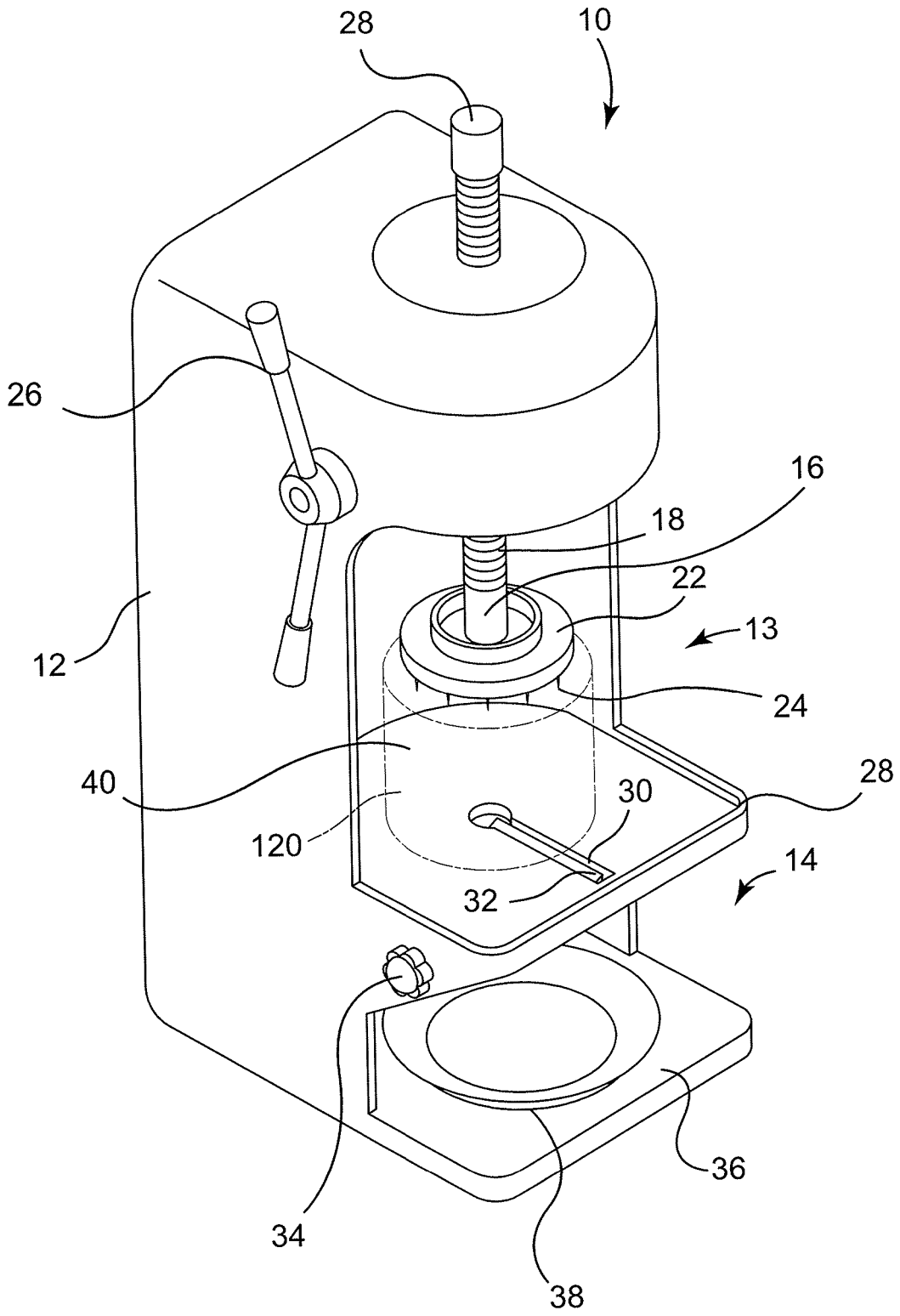
FIG. 1 is a perspective view of a prior art shave ice device.

FIG. 1 shows a perspective view of a prior art shaving device 10. The device 10 generally includes a main body 12, defining an upper compartment 13 and a lower compartment 14. The device 10 includes a shaft 16, having threading 18. One end of the shaft is connected to a stopper 20, while the other end of the shaft 16 is connected to a gripping plate 22. The gripping plate 22 has spikes 24 extending from a lower surface of the plate. The shaft 16 is mechanically coupled (not shown) with a handle 26. The mechanical coupling is configured such that rotating the handle 26 imparts vertical motion on the shaft 16 (e.g., the shaft moves toward or away from the second compartment 14 along a vertical axis). The spikes 24 allow the gripping plate 22 to grip an ice block 40 mounted within the first compartment 13. The device 10 further includes a shaft-rotating mechanism (not shown) that rotates the shaft 16.

The upper compartment 13 and the lower compartment 14 are separated by a shaving plate 28. The shaving plate 28 includes an opening 30 with a blade 32 mounted thereon. As shown in FIG. 1, the opening 30 is generally rectangular in shape and extends in from about the center of the ice block 40 (when the ice block 40 is mounted thereon) in a radial direction to the edge of the mounting plate 28. The opening 30 is generally much longer than its width for an elongated blade 32 to extend in a similar manner. The angle of the blade is controllable by a knob 34. The lower compartment 14 is positioned directly below the upper compartment 13 and includes a plate-receiving surface 36. A plate 38 may be mounted on the plate-receiving surface 26. As shown in FIG. 1, when the plate 38 is disposed on the plate-receiving surface 36, the plate 38 is posited directly below the opening 30 and the blade 32.

In operation, the device 10 starts in an unused state in which the ice block 40 is not yet mounted on the shaving plate 28. When a customer orders a shave ice, the operator of the device 10 retrieves a cylindrical ice block 40 from a remote freezer. The operator places the ice block 40 onto the shaving plate 28 such that a bottom surface of the ice block 40 contacts the blade 32. The operator rotates the handle 26 thereby lowering the shaft 16, which in turn lowers the gripping plate 22 and spikes 24. Once the spikes 24 contact the ice block 40 in a secure manner, the operator stops rotating the handle 26. The operator adjusts the blade 32 with the knob 34 if necessary. The operator places a places the plate 38 onto the plate-receiving surface 36. The operator then turns on the shaft-rotating mechanism, such as a motor coupled with the shaft, that rotates the shaft 16. Because the shaft 16 is attached to the ice block 40 via the spikes 24, the ice block 40 rotates. The rotation motion of the ice block 40, along with contact of the blade 32, shaves the ice which drops through the opening 30 onto the plate 38. During the rotation of the ice block 40 the operator may have to manually readjust the ice block 40 and/or manually readjust the plate 38 to ensure proper distribution of the shave ice. Finally, when enough shave ice has been deposited onto the plate 38, the operator must reverse the above ice block mounting steps to free the ice block 40 from the device (e.g., turning the handle 26 in the opposite direction so that the shaft 16 lifts from the ice block 40). The operator then manually returns the ice block 40 to the remote freezer. The entire process is repeated every time a customer orders a shave ice.

Figure 2:
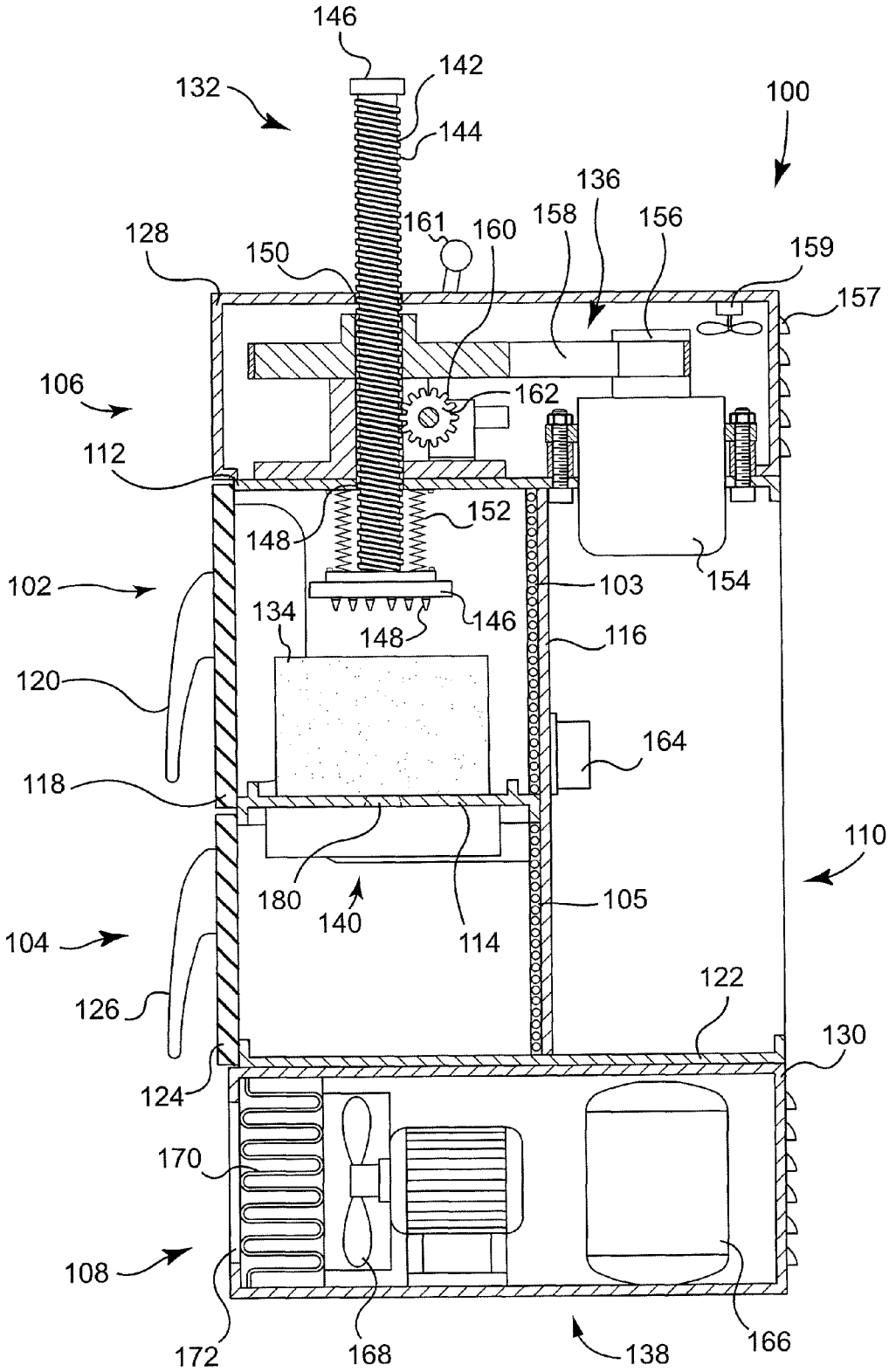
FIG. 2 is a side cross-sectional view of a shave ice device in accordance with aspects of the present invention.

FIG. 2 show a side cross sectional views of a shave ice device 100, in accordance with aspects of the present invention. As shown in FIG. 2, the shave ice device 100 may include five compartments: an upper front compartment 102, a lower front compartment 104, a top compartment 106, a bottom compartment 108 and a rear compartment 110. The upper front compartment 102 may be separated from the top compartment 106 by a first dividing panel 112, separated from the lower front compartment 104 by a shaving plate 114, and separated from the rear compartment 110 by a second dividing panel 116. The upper front compartment 102 may be separated from ambient air by a first door 118. The first door 118 may include an opening mechanism 120 (e.g., a handle) along with hinges (not shown) to allow the door to be opened by actuating the opening mechanism 120. When the first door 118 is closed, the upper front compartment 102 may be defined by the first dividing panel 112, the shaving plate 114, the second dividing panel 116, and the first door 118.

The lower front compartment 104 may be separated from the upper front compartment by the shaving plate 114, may be separated from the rear compartment 110 by the second dividing panel 116, and separated from the bottom compartment 108 by a base plate 122. The lower front compartment 104 may be separated from ambient air by a second door 124. The second door 124 may include an opening mechanism 126 (e.g., a handle) along with hinges (not shown) to allow the door to be opening by actuating the opening mechanism 126. When the second door 124 is closed, the lower front compartment 104 may be defined by the shaving plate 114, the second dividing panel 116, the base plate 122, and the second door 124.

The top compartment 106 may be separated from the both the upper front compartment 102 and the rear compartment 110 by the first dividing panel 112. The top compartment may otherwise be enclosed by a housing 128. The top compartment 106 may be defined by the housing 128 and the first dividing panel 112. The bottom compartment 108 may be enclosed within a housing 130 and may be separated from the both the lower front compartment 104 and the rear compartment 110 by the base plate 122. While the base plate 122 and the housing 130 are shown as separate elements contacting each other, in accordance with aspects of the present invention, the base plate 122 can either be integral with the housing 130, or, the base plate 122 could serve the dual function of separating the compartments and acting as a portion of the housing of the bottom compartment 108. Thus, the bottom compartment 106 may be defined by the housing or may be defined by the housing together with the base plate 122.

The rear compartment 110 may be separated from the top compartment 106 by the first dividing panel 112, separated from both the upper front compartment 102, separated from the lower front compartment 104 by the second dividing panel 116, and separated from the bottom compartment by the base plate 122. The rear compartment 110 may be defined by the first dividing panel 112, the second dividing panel 116, and the base plate 122. As shown in FIG. 2, the rear compartment may be open to ambient air on one side. In an aspect of the present invention, the rear compartment 110 may be entirely enclosed.

The shave ice device 100 may further include a gripping mechanism 132 for gripping an ice block 134, a rotating mechanism 136 for rotating the gripping mechanism 132, a cooling mechanism 138, and a shaving mechanism 140 for shaving the ice block 134. The gripping mechanism 132 may include a shaft 142 having screw-like threading 144 on the surface that extends substantially vertically (e.g., perpendicular to the shaving plate 114). A gripping plate 146 having gripping teeth 148 extending toward the shaving plate 114 may be attached to an end of the shaft 142 closer to the shaving plate 114. The other end of the shaft 142 may include a stopper 146. As shown in FIG. 2, the end of the shaft 142 having the gripping plate 146 may be disposed in the upper front compartment, and the shaft 142 may extend upwardly (e.g., in a direction away from the gripping plate 146) though an orifice 148 formed in the first dividing panel 112, through the top compartment 106, and through an orifice 150 formed in the housing 128 such that a portion of the shaft including the stopper 146 is external to the housing 128. The gripping mechanism 132 may further include an extendible sealing mechanism 152 surrounding a portion of the shaft 142 and attached on one end to the gripping plate 146 and on the other end to a surface of the dividing panel 112. The extendible sealing mechanism 152 may seal the shaft 142 from the environment in the upper front compartment 102, thus preventing condensation from forming on the shaft 142. The temperature of the upper front compartment 102 is maintained at below freezing, such as −20 degrees Celsius or lower. Further, the housing 128 may be sized to totally encompass the shaft 142.

The rotating mechanism 136 may be coupled with the shaft 142 such that, when operated, the rotating mechanism 136 rotates the shaft 142. The rotating mechanism 136 may include a motor 154, an output shaft 156 coupled to the motor 154, and a drive belt 158 coupled to the output shaft 156, which links rotational movement of the output shaft 156 to the shaft 142. The shave ice device 100 may further include an actuator 160 coupled with the shaft 142. For example, the actuator 160 may be a gear having spokes 162 that mate with the threading 144 of the shaft 142. The actuator 160 may be coupled with a handle 161 (e.g., as shown in FIG. 1) external to the house housing 128. The handle 161 may be coupled to the actuator 160 such that rotation of handle 161 imparts rotation on the actuator 160. This rotation may in turn raise the shaft 142 (e.g., move away from the shaving plate 114) or lower the shaft 142 (e.g. move toward the shaving plate 114) due to the mating of the actuator 160 with the shaft 142. As shown in FIG. 2, in an aspect of the present invention, the actuator 160, belt 158, output shaft 156, and a portion of the motor 154 may be disposed within the top compartment 106, and a portion of the motor 154 may extend into the rear compartment 110. In another aspect of the present invention, the entire motor 154 may be disposed within the top compartment 106, e.g., such that the entire rotating mechanism 136 is located within the top compartment 106. Accordingly, the rotating mechanism 136 may be disposed partly or entirely within the top compartment 106. The housing 128 may further include one or more vents 157 or one or more fans 159.

The cooling mechanism 138 may include typical components of a freezer such as found in a home refrigerator unit or air conditioner. For example, the cooling mechanism 138 may include a compressor 166, a cooling fan 168, and coils 170. The coil tubing may pass through the lower front chamber 104 and through the upper front chamber 102, such as along coil plates 103, 105 disposed alongside the second dividing panel 116. Coil plates may also be disposed along all internal surfaces of the lower front chamber 104 and the upper front chamber 102. The cooling mechanism may operate similar to a standard freezer or air conditioner. For example, refrigerant/coolant, such as FREON®, may be compressed in gas form into the condenser coil portion of the coils 170, where the refrigerant is condensed. The excess heat produced by the compression is expelled through a vent 172 via the cooling fan 168. The compressed refrigerant passes through the evaporator coil portion of coils 170, which is the portion of the coil that present in the lower front chamber 104 and upper front chamber 102 (i.e., the portion contained between the plates 103, 105). As the liquid refrigerant evaporates, it absorbs heat thereby causing the cooling effect. The coils then return to the compressor and the process repeats itself to maintain a temperature below freezing in the upper front and lower front chambers.

As shown in FIG. 2, the condenser 166, the fan 168, the condenser portion of the coil 170, and the vent 172, may all be disposed in the bottom compartment 108. This arrangement separates the heat formed in the condenser portion of the coil 170 from entering the lower front compartment 104 or the upper front compartment 102. Thus, when the first door 118 and the second door 124 are closed, the lower front compartment 104 and the upper front compartment are sealed and remain insulated from heat sources. To assist in maintaining the proper temperature in the lower front compartment 104 and the upper front compartment 102, a thermostat 164 may be implemented, which detects the temperature of the compartments. The thermostat may report the temperature to a controller (not shown) that may control the cooling mechanism 138. For example, when the temperature detected by the thermostat rises above the desired temperature (e.g., above −20 degrees Celsius), the controller would turn on and the cooling mechanism 138 and when the detected temperature reaches a threshold value determined to be too far below freezing, the controller would turn the cooling mechanism 138. This control may be performed using methods known in the refrigeration art. To assist the efficiency of the cooling, each of the walls defining the upper front compartment 102 and the lower front compartment 106 may be formed from an insulating material and/or have an insulating layer disposed thereon. For example, the one or more or all of the dividing panels 112, the shaving plate 114, the second dividing panel 116, and the base blade may be formed of an insulating material and/or have an insulating layer disposed thereon.

Figure 3:
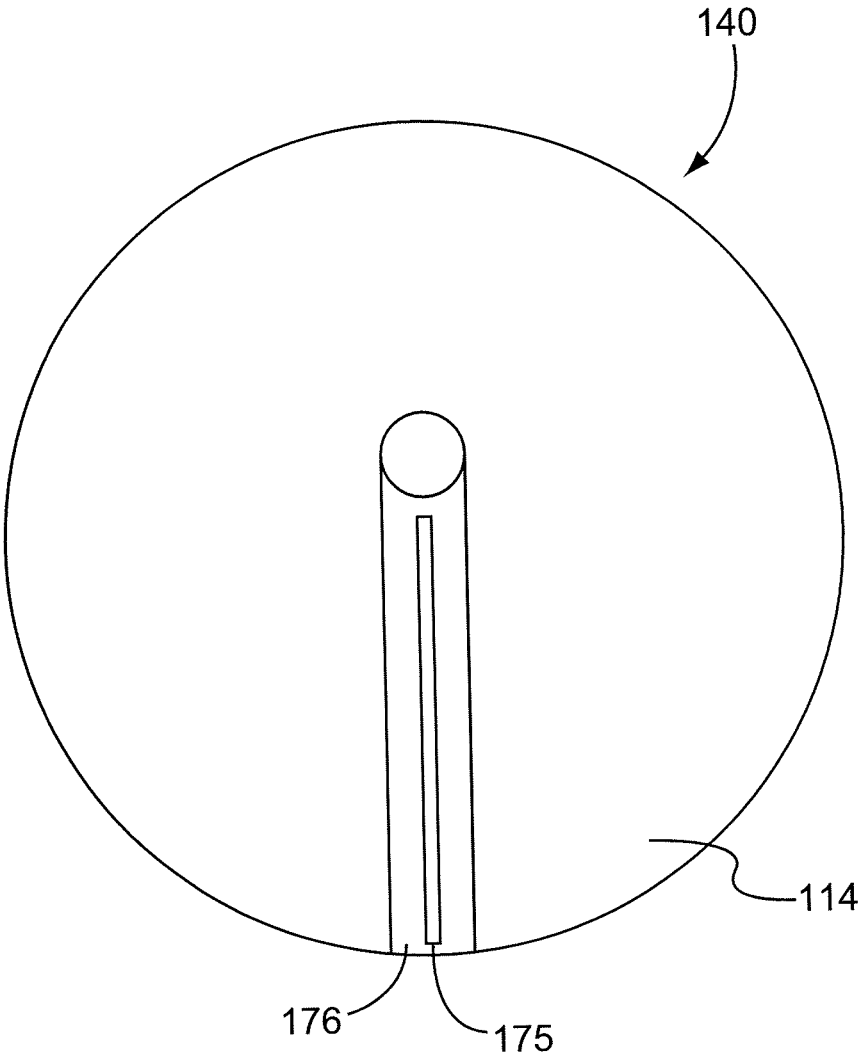
FIG. 3 is a bottom schematic view of a shaving plate of the shave ice device of FIG. 2 in accordance with aspects of the present invention.
Figure 9:
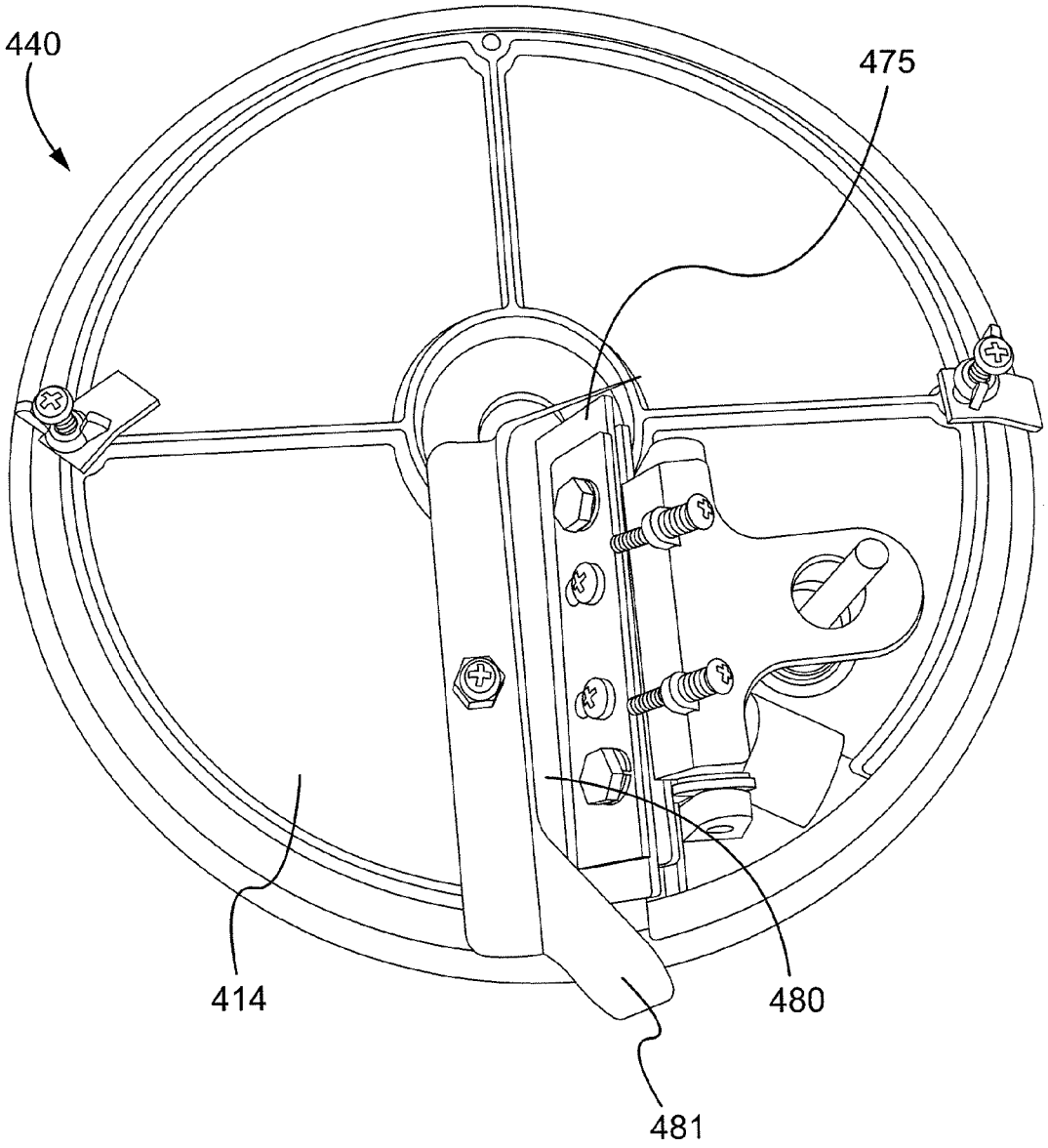
FIG. 9 is a bottom view of a shaving plate of the shave ice device of FIG. 8 in accordance with aspects of the present invention.

The shaving mechanism 140 may include the shaving plate 114 and a blade 175 mounted thereon, which is best seen in FIG. 3. For clarity, the mechanism for mounting the blade onto the shaving plate and the mechanism for altering the angle of the blade are omitted. As shown in FIG. 2, the upper surface of the shaving plate 114 may abut the lower surface of the ice block 134 when an ice block is mounted thereon. FIG. 3 shows a bottom view looking up (i.e., the surface of the shaving plate 114 viewable in FIG. 3 faces the upper surface of the base plate 122) of the shaving plate 114 with shaving blade 175 mounted thereon. The shaving blade 175 may be mounted so that it extends through an opening 180 of the shaving plate 114. The blade 175 may extend into the opening 180 thereby contacting the ice block 134. FIG. 9, which is described in more detail below illustrates similar structure.

Figure 4:
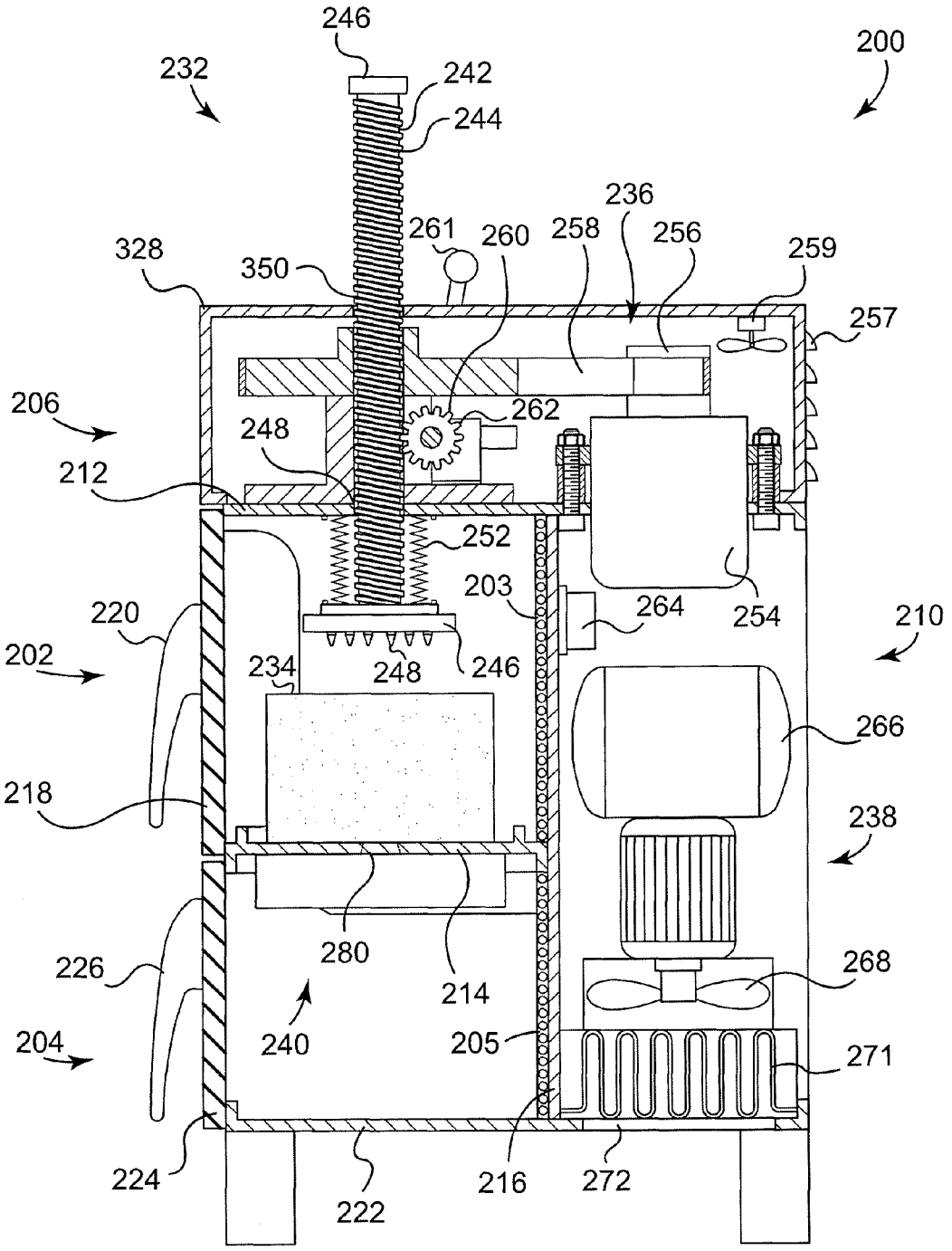
FIG. 4 is a side cross-sectional view of a shave ice device in accordance with aspects of the present invention.

FIG. 4 shows a shave ice device 200, in accordance with aspects of the present invention. The shave ice device 200 is similar to the shave ice device shown in FIG. 2, except that the lower front compartment is no longer present. Instead, as shown in FIG. 4, the features contained in the lower front compartment of FIG. 2 are present in the rear compartment 210. The elements of the shave ice device 200 corresponding to the elements of shave ice device 100 use similar reference numbers.

As shown in FIG. 4, the shave ice device 200 may include four compartments: an upper front compartment 202, a lower front compartment 204, a top compartment 206, and a rear compartment 210. The upper front compartment 202 may be separated from the top compartment 206 by a first dividing panel 212, separated from the lower front compartment 204 by a shaving plate 214, and separated from the rear compartment 210 by a second dividing panel 216. The upper front compartment 202 may be separated from ambient air by a first door 218. The first door 218 may include an opening mechanism 220 (e.g., a handle) with optional hinges (not shown) to allow the door to be opened by actuating the opening mechanism 220. When the first door 218 is closed, the upper front compartment 202 may be defined by the first dividing panel 212, the shaving plate 214, the second dividing panel 216, and the first door 218.

The lower front compartment 204 may be separated from the upper front compartment by the shaving plate 214 and may be separated from the rear compartment 210 by the second dividing panel 216. The lower front compartment 104 may be separated from ambient air by a second door 224 and a base plate 222. The second door 224 may include an opening mechanism 226 (e.g., a handle) with optional hinges (not shown) to allow the door to be opening by actuating the opening mechanism 226. When the second door 224 is closed, the lower front compartment 204 may be defined by the shaving plate 214, the second dividing panel 216, the base plate 222, and the second door 224.

The top compartment 206 may be separated from both the upper front compartment 202 and the rear compartment 210 by the first dividing panel 212. The top compartment may otherwise be enclosed by a housing 228. The top compartment 206 may be defined by the housing 228 and the first dividing panel 212.

The rear compartment 210 may be separated from the top compartment 206 by the first dividing panel 212, and separated from both the upper front compartment 202 and the lower front compartment by the second dividing panel 216. A portion of the base plate 222 may also enclose a bottom portion of the rear compartment 210. The rear compartment 210 may be defined by the first dividing panel 212, the second dividing panel 216, and the base plate 222. As shown in FIG. 2, the rear compartment may be open to ambient air on one side. In an aspect of the present invention, the rear compartment 210 may be entirely enclosed.

The shave ice device 200 may further include a gripping mechanism 232 for gripping an ice block 234, a rotating mechanism 236 for rotating the gripping mechanism 232, a cooling mechanism 238, and a shaving mechanism 240 for shaving the ice block 234. The gripping mechanism 232 may include a shaft 242 having screw-like threading 244 on the surface that extends substantially vertically (e.g., perpendicular to the shaving plate 214). A gripping plate 246 having gripping teeth 248 extending toward the shaving plate 214 may be attached to an end of the shaft 242 closer to the shaving plate 214. The other end of the shaft 242 may include a stopper 246. As shown in FIG. 4, the end of the shaft 242 having the gripping plate 246 may be disposed in the upper front compartment, and the shaft 242 may extend upwardly (e.g., in a direction away from the gripping plate 246) though an orifice 248 formed in the first dividing panel 212, through the top compartment 206, and through an orifice 250 formed in the housing 228 such that a portion of the shaft including the stopper 246 is external to the housing 228. The gripping mechanism 232 may further include an extendible sealing mechanism 252 surrounding a portion of the shaft 242 and attached on one end to the gripping plate 246 and on the other end to a surface of the dividing panel 212. The extendible sealing mechanism 252 seals the shaft 242 from the environment in the upper front compartment 202, thus preventing condensation from forming on the shaft 242. The temperature of the upper front compartment 202 is maintained at below freezing, which is discussed in more detail below. Further, the housing 228 may be sized to completely encompass the shaft 242.

The rotating mechanism 236 may be coupled with the shaft 242 such that, when operated, the rotating mechanism 236 rotates the shaft 242. The rotating mechanism 236 may include a motor 254, an output shaft 256 coupled to the motor 254, and a drive belt 258 coupled to the output shaft 256, which links rotational movement of the output shaft 256 to the shaft 242. The shave ice device 200 may further include an actuator 260 coupled with the shaft 242. For example, the actuator 260 may be a gear having spokes 262 that mate with the threading 244 of the shaft 242. The actuator 260 may be coupled with a handle 261 (e.g., as shown in FIG. 1) external to the house housing 228. The handle 261 may be coupled to the actuator 260 such that rotation of handle 261 imparts rotation on the actuator 260. This rotation may in turn raise the shaft 242 (e.g., move away from the shaving plate 214) or lower the shaft 242 (e.g. move toward the shaving plate 214) due to the mating of the actuator 260 with the shaft 242. As shown in FIG. 4, in an aspect of the present invention, the actuator 260, belt 258, output shaft 256, and a portion of the motor 254 may be disposed within the top compartment 206, and a portion of the motor 254 may extend into the rear compartment 210. In another aspect of the present invention, the entire motor 254 may be disposed within the top compartment 206, e.g., such that the entire rotating mechanism 236 is located within the top compartment 206. Accordingly, the rotating mechanism 236 may be disposed partly or entirely within the top compartment 206. The housing 228 may further include one or more vents 257 or one or more fans 259.

The cooling mechanism 238 may include typical components of a freezer such as found in a home refrigerator unit or air conditioner. For example, the cooling mechanism 238 may include a compressor 266, a cooling fan 268, and coils 270. The coil tubing may pass through the lower front chamber 204 and through the upper front chamber 202, such as along a coil plates 203, 205 disposed alongside the second dividing panel 216. Coil plates may also be disposed along all internal surfaces of the lower front chamber 204 and the upper front chamber 202. The cooling mechanism may operate in a similar manner to the one discussed above. For example, refrigerant/coolant, such as FREON®, may be compressed in gas form into the condenser coil portion of the coils 270, where the refrigerant is condensed. The excess heat produced by the compression is expelled through a vent 272 via the cooling fan 268. The compressed refrigerant passes through the evaporator coil portion of coils 270, which is the portion of the coil that is present in the lower front chamber 204 and upper front chamber 202 (i.e., the portion contained between the plates 203, 205). As the liquid refrigerant evaporates, it absorbs heat thereby causing the cooling effect. The coils then return to the compressor and the process repeats itself maintain a temperature below freezing in the upper front and lower front chambers.

As shown in FIG. 4, the condenser 266, the fan 268, the condenser portion of the coil 270, and the vent 272 may all be disposed in the rear compartment 210. This arrangement separates the heat formed in the condenser portion of the coil 270 from entering the lower front compartment 204 or the upper front compartment 202, while providing a more compact design. Thus, when the first door 218 and the second door 224 are closed, the lower front compartment 204 and the upper front compartment 202 are sealed and remain insulated from heat sources. To assist in maintaining the proper temperature in the lower front compartment 204 and the upper front compartment 202, a thermostat 264 may be implemented, which may detect the temperature of the compartments. The thermostat may report the temperature to a controller (not shown) that may control the cooling mechanism 238. For example, when the temperature detected by the thermostat rises above a desired temperature (e.g., above −20 degrees Celsius), the controller would turn on and the cooling mechanism 238 and when the detected temperature reaches a threshold value determined to be too far below freezing, the controller would turn the cooling mechanism 238. This control may be performed using methods known in the refrigeration art. To assist the efficiency of the cooling, each of the walls defining the upper front compartment 202 and the lower front compartment 206 may be formed from an insulating material and/or have an insulating layer disposed thereon. For example, the one or more or all of the dividing panel 212, the shaving plate 214, the second dividing panel 216, and the base plate may be formed of an insulating material and/or have an insulating layer disposed thereon.

The shaving mechanism 240 may include the shaving plate 214 and a blade mounted thereon. The shaving plate 214 may be similar to the shaving plate 114 discussed above and shown in FIG. 3. This includes a similar blade to the shaving blade 175 that may be mounted so that it extends through an opening 280 of the shaving plate, thereby contacting the ice block 234 resting on the shaving plate 214.

Figure 5:
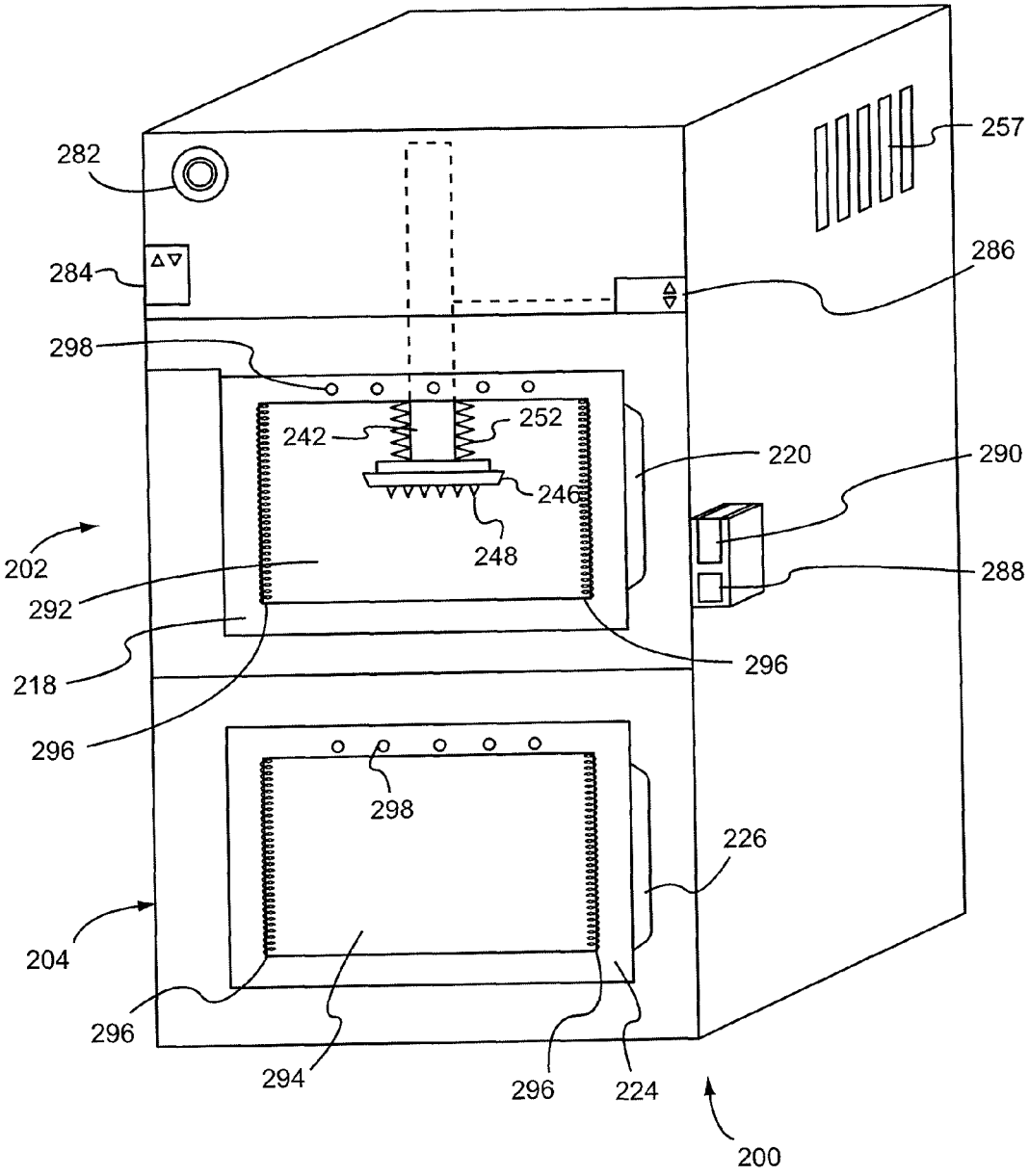
FIG. 5 is a perspective view of the shave ice device of FIG. 4.

FIG. 5 shows a front perspective view of the shave ice device 200. As shown in FIG. 5, the shave ice device may include a power timer 282, a thermostat 284, a dispensing timer 286, a start button 288, and a shutoff button 290. The buttons 288, 290 may be located at any position convent to the operator. The thermostat 284 may be in addition to or replace the thermostat 264. As shown in FIG. 4, buttons 288, 290 may be attached to an outer surface of the shave ice device 100 at a location adjacent to the first door 218, such as adjacent to the opening mechanism 220. Buttons 288, 290 may individually or both be electronically, mechanically or electromechanically coupled with the rotating mechanism 136 (specifically the motor 254 of the rotating mechanism 136), such that pressing the start button 288 starts operation of the motor 254 and shutoff button 290 stops operation of the motor. The dispensing timer may be adjustable and set to an average amount of time for dispensing shave ice for a single customer. For example, the dispensing timer may be set to a time of 5, 10, 15, 20, etc. seconds. The time could also be directly related to the size of the order. For example, a "large" order could be associated with a timer of 20 seconds, while a "small" order could be associated with a time of 10 seconds. The start button 288 may be electronically coupled with the dispensing timer 286 such that pressing of the start button 288 may start a countdown on the timer. Once the dispensing timer 286 reaches 0, the dispensing of ice may automatically stop. The shutoff button 290 may operate as a normal shut off button if a dispensing timer 286 is not present, or it can act as an overriding emergency stop when a dispensing timer 286 is present. In another aspect, if no dispensing timer is present, the start button 288 may operate such that the dispensing continues as long as the operator is holding down the button 288, but immediately stops once the button is no longer pressed (e.g., a dead man switch).

Each door 218, 224 may include a transparent panel 292, 294. The transparent panels may comprise an insulating material, for example, triple layer tempered glass. A defrosting mechanism 296 (e.g., defrost coils) may be disposed around the panels 292, 294 to prevent frost forming on the panels. Lighting 298, such as LED lighting, may be disposed along an edge (e.g., an upper edge) of the panels 292, 294 to illuminate the inside of the compartments 202, 204.

While FIG. 5 shows a view corresponding to the shave ice device of FIG. 4, all of the features shown therein are equally applicable to the shave ice device 100 shown in FIG. 2. The thermostat, the power timer, the dispensing timer, the start button, the shut off button, the panels, the coils, and the lighting may also be present in the shaving device of FIG. 2.

Operation of the shave ice device will now be described. It should be noted that the shave ice device of FIG. 2 and the shave ice device of FIG. 4 are operated a similar manner. Prior to the first use, the device 100, 200 will be turned on so that the cooling mechanism 138, 238 can reduce the temperature in the upper front compartment 102, 202 and the lower front compartment 104, 204 to a suitable temperature to store ice (e.g., 20 degrees Celsius below freezing temperature). This step can be performed manually or automatically. Manual operation would require the owner/facility operator to turn on the device. In an automatic setting, the owner/facility operator sets the power timer 282 to turn on the machine at a certain time of the day. For example, the power timer 282 can be set to an amount of time necessary for the compartments to reach 20 degrees Celsius below freezing temperature prior to the start of business hours, such as 1-2 hours. With this setting, the compartments may already be at the proper temperature when the owner/facility operator arrives. The particular desired temperature can be preset using the thermostat 284. The owner/facility operator retrieves a block of ice 134, 234 from a separate freezer, opens the door 118, 218 of the front compartment, and places the block of ice 134, 234 on the shaving plate 114, 214. The owner/facility operator then adjusts the height of the shaft 142, 242 by operating a handle 161, 261 that rotates the actuator 160, 260. The owner/facility operator lowers the shaft 142, 242 until the spikes 148, 248 securely contact the block of ice 134, 234. As the shaft 142, 242 lowers, the sealing mechanism 152, 252 extends, and creates and maintains a seal between the shaft 142, 242, and the freezing conditions of the upper front compartment 102, 202, thereby preventing condensation from forming on the shaft 142, 242. Once the shaft 142, 242 is secured to the ice block 134, 234 via the spikes 148, 248, the device is ready for operation by a machine operator (e.g., a customer). The owner/facility operator no longer need not have any involvement with operating the device other than occasional cleaning, replacement of the ice block once it has been spent, and/or end of they day shut down.

The machine operator is now able to operate the device to shave the ice block 134, 234 without assistance. The machine operator first opens the door 124, 224, and places a shave shaving plate on top of the base plate 122, 222 within the lower front compartment 104, 204. The machine operator then closes the door 124, 224. The machine operator has no need to interact with the ice block 134, 234 or the shaft 142, 242. During this operation, the cooling mechanism 138, 238 continues to keep the upper front compartment 102, 202, and the lower front compartment 104, 204 at the proper sub-freezing temperature (e.g., about −20 degrees Celsius or lower). The machine operator then presses the start button 288. When dispensing timer 286 is present, the timer 286 will begin to count down and the operation of the rotating mechanism 136, 236 will begin. In particular the motor 154, 254 will output rotational motion that may be translated to the gripping mechanism 132, 232 (in particular rotation of the shaft 142, 242) via the mechanical components described above. The rotation of the gripping mechanism 132, 232 (in particular the shaft 142, 242) rotates the ice block 134, 234. The rotation of the ice block 134, 234 passes over the blade 175, which shaves the ice block 134, 234 and drops the shavings on the plate that was placed by the customer into the lower front compartment 104, 204.

The shaving process will continue until the dispensing timer reaches zero. Once the dispensing timer reaches zero, operation of the rotating mechanism 136, 236 will terminate and the shaved ice may be ready to be retrieved by the machine operator. In an aspect, the timer can be increased to control the amount of shavings that will be dispensed. In another aspect, rather than automatically dispensing until the timer expires, the device may be configured such that the dispensing continues as long as the start button 288 is pressed. In another aspect the device may be configured such that the dispensing will continue until the stop button 290 is pressed. In another aspect, for the automatic dispensing, the stop button 290 may act as an emergency stop to override the automatic dispensing. As noted above, the time set on the timer 286 can be correlated to a particular size of the order such as small, medium, large, etc., where increasing sizes are correlated with increasing dispensing times.

The LED lights may be lit so that the machine operator can see the ice being dispensed. The visual feedback assists the user in understanding that the device is operating. In an aspect, the lighting 298 may be electronically configured to turn on and turn off only when the machine in dispensing. This provides further visual feedback to the customer that the dispensing is in process and when the dispensing is completed. The coils 296 further contribute to the visual feedback by preventing frosting on the transparent panels 292, 294.

After the dispensing is complete, the machine operator opens the door 124, 224, retrieves the plate containing shaved ice. The above machine operator-performed steps can then be repeated for each additional customer without the need for the owner/facility operator to be involved. The cooling mechanism 138, 238 maintains the proper temperature (e.g., about −20 degrees Celsius or below) in the compartments 102, 204 through the various uses. As noted above, the owner/facility operator need only interact with the device to insert a new block of ice or clean the machine, as necessary.

Figure 6:
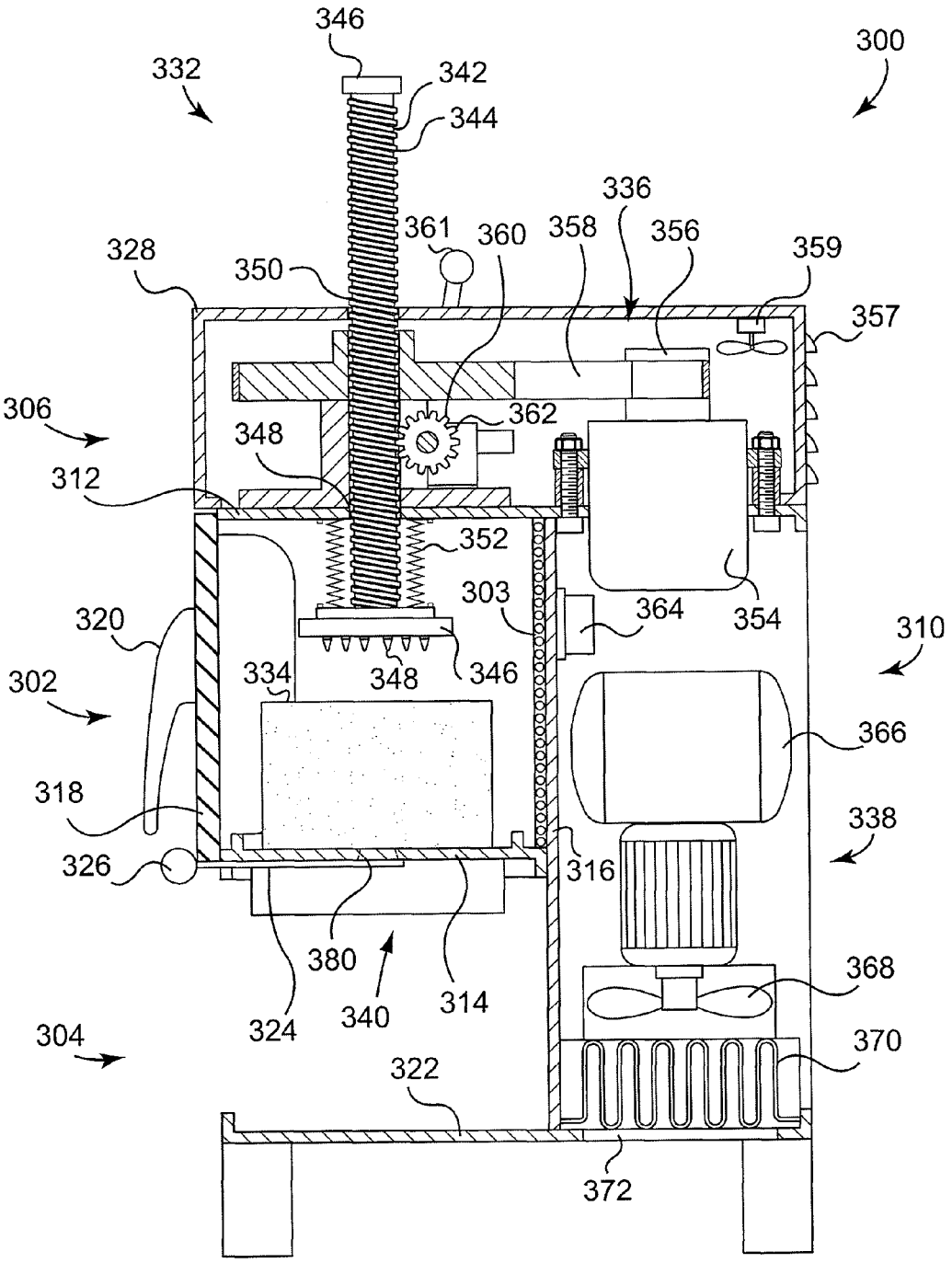
FIG. 6 is a side cross-sectional view of a shave ice device in accordance with aspects of the present invention.
Figure 7:
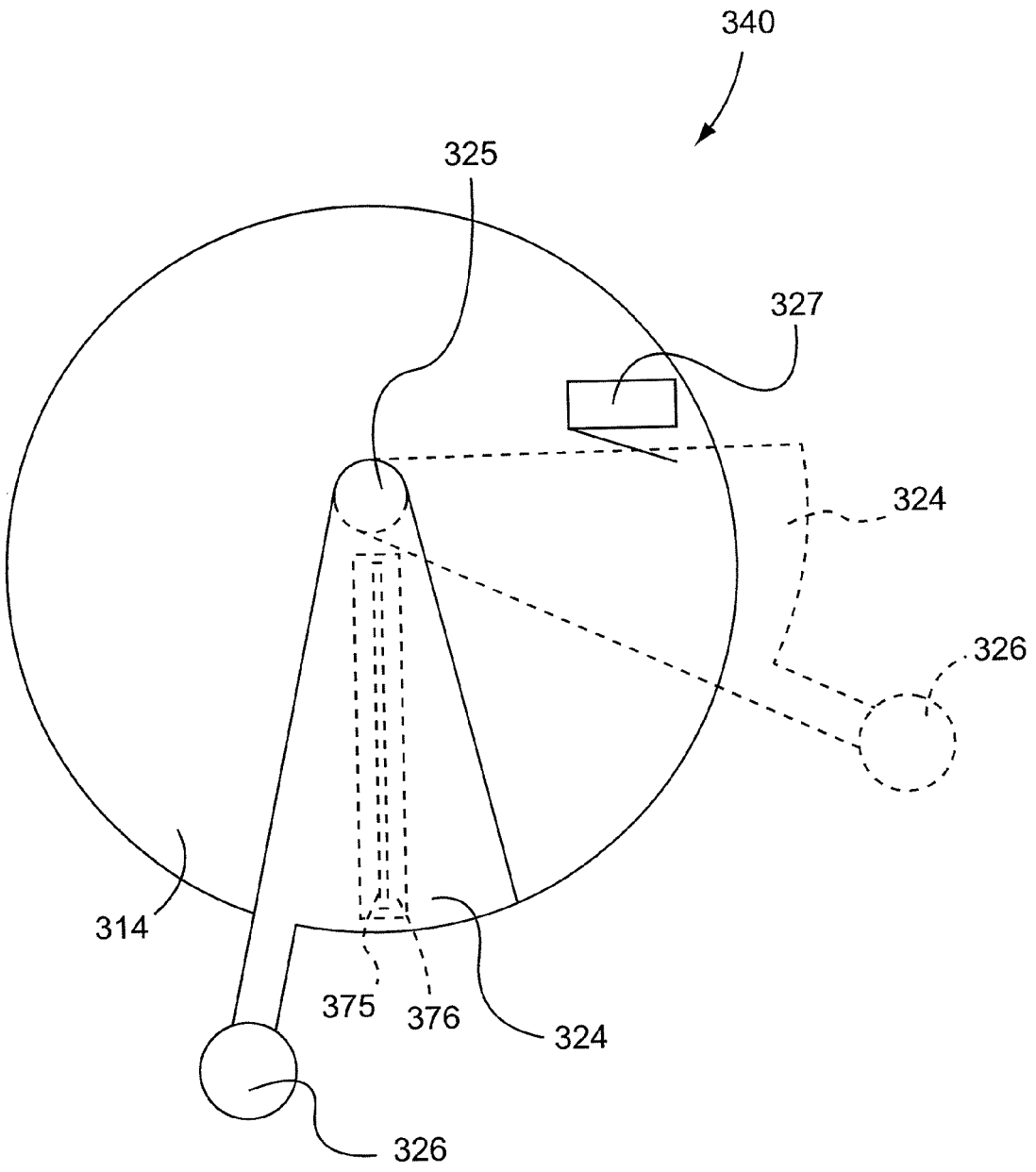
FIG. 7 is a bottom schematic view of a shaving plate of the shave ice device of FIG. 6, in according with aspects of the present invention.

FIGS. 6 and 7 show a shave ice device 300 and shaving plate 314 in accordance with other aspects of the present invention. The shave ice device 300 is similar to the shave ice devices 100, 200 illustrated in FIGS. 2-4 and similar elements have similar reference numbers. The primary difference is that the shave device 300 may avoid the need to maintain a temperature below freezing in the lower front compartment by use of a rotatable door, described below.

As shown in FIG. 6, the shave ice device 300 may include four compartments: an upper front compartment 302, a lower front compartment 304, a top compartment 306, and a rear compartment 310. The upper front compartment 302 may be separated from the top compartment 306 by a first dividing panel 312, separated from the lower front compartment 304 by a shaving plate 314, and separated from the rear compartment 310 by a second dividing panel 316. The upper front compartment 302 may be separated from ambient air by a first door 318. The first door 318 may include an opening mechanism 320 (e.g., a handle) along with optional hinges (not shown) to allow the door to be opened by actuating the opening mechanism 320. When the first door 318 is closed, the upper front compartment 302 may be defined by the first dividing panel 312, the shaving plate 314, the second dividing panel 316, and the first door 318.

The lower front compartment 304 may be separated from the upper front compartment by the shaving plate 314 and may be separated from the rear compartment 310 by the second dividing panel 316. The lower front compartment 304 may be open ambient air on the front side and be separated from ambient air on the lower side by a base plate 322. The lower front compartment 304 may be defined by the shaving plate 314, the second dividing panel 316, and the base plate 322.

The top compartment 306 may be separated from both the upper front compartment 302 and the rear compartment 310 by the first dividing panel 312. The top compartment may otherwise be enclosed by a housing 328. The top compartment 306 may be defined by the housing 328 and the first dividing panel 312.

The rear compartment 310 may be separated from the top compartment 306 by the first dividing panel 312, separated from both the upper front compartment 302 and separated from the lower front compartment by the second dividing panel 316. A portion of the base plate 322 may also enclose a bottom portion of the rear compartment 310. The rear compartment 310 may be defined by the first dividing panel 312, the second dividing panel 316, and the base plate 322. As shown in FIG. 6, the rear compartment may be open to ambient air on one side. In an aspect of the present invention, the rear compartment 310 may be completely enclosed.

The shave ice device 300 may further include a gripping mechanism 332 for gripping an ice block 334, a rotating mechanism 336 for rotating the gripping mechanism 332, a cooling mechanism 338, and a shaving mechanism 340 for shaving the ice block 334. The gripping mechanism 332 may include a shaft 342 having screw-like threading 344 on the surface that extends substantially vertically (e.g., perpendicular to the shaving plate 314). A gripping plate 346 having gripping teeth 348 extending toward the shaving plate 314 may be attached to an end of the shaft 342 closer to the shaving plate 314. The other end of the shaft 342 may include a stopper 346. As shown in FIG. 6, the end of the shaft 342 having the gripping plate 346 may be disposed in the upper front compartment, and the shaft 342 may extend upwardly (e.g., in a direction away from the gripping plate 346) though an orifice 348 formed in the first dividing panel 312, through the top compartment 306, and through an orifice 350 formed in the housing 328 such that a portion of the shaft including the stopper 346 is external to the housing 328. The gripping mechanism 332 may further include an extendible sealing mechanism 352 surrounding a portion of the shaft 342 and attached on one end to the gripping plate 346 and on the other end to a surface of the dividing panel 312. The extendible sealing mechanism 352 seals the shaft 342 from the environment in the upper front compartment 302, thus preventing condensation from forming on the shaft 342. The temperature of the upper front compartment 302 is maintained at below freezing, which is discussed in more detail below. Further, the housing 328 may be sized to completely encompass the shaft 342.

The rotating mechanism 336 may be coupled with the shaft 342 such that, when operated, the rotating mechanism 336 rotates the shaft 342. The rotating mechanism 336 may include a motor 354, an output shaft 356 coupled to the motor 354, and a drive belt 358 coupled to the output shaft 356, which links rotational movement of the output shaft 356 to the shaft 342. The shave ice device 300 may further include an actuator 360 coupled with the shaft 342. For example, the actuator 360 may be a gear having spokes 362 that mate with the threading 344 of the shaft 342. The actuator 360 may be coupled with a handle 361 (e.g., as shown in FIG. 1) external to the house housing 328. The handle 361 may be coupled to the actuator 360 such that rotation of handle 361 imparts rotation on the actuator 360. This rotation may in turn raise the shaft 342 (e.g., move away from the shaving plate 314) or lower the shaft 342 (e.g. move toward the shaving plate 314) due to the mating of the actuator 360 with the shaft 342. As shown in FIG. 6, in an aspect of the present invention, the actuator 360, belt 358, output shaft 356, and a portion of the motor 354 may be disposed within the top compartment 306, and a portion of the motor 354 may extend into the rear compartment 310. In another aspect of the present invention, the entire motor 354 may be disposed within the top compartment 306, e.g., such that the entire rotating mechanism 336 is located within the top compartment 306. Accordingly, the rotating mechanism 336 may be disposed partly or entirely within the top compartment 306. The housing 328 may further include one or more vents 357 or one or more fans 359.

The cooling mechanism 338 may include typical components of a freezer such as found in a home refrigerator unit or air conditioner. For example, the cooling mechanism 338 may include a compressor 366, a cooling fan 368, and coils 370. The coil tubing may pass through the upper front chamber 302, such as along coil plates 303 disposed alongside the second dividing panel 316. Coil plates may also be disposed along all internal surfaces of the upper front chamber 302. However, the coil tubing/coil plate does not need to be present in the lower front chamber 304 because the lower front chamber 304 is open to ambient air. The cooling mechanism may operate in a manner similar to the one discussed above. For example, refrigerant/coolant, such as FREON®, may be compressed in gas form into the condenser coil portion of the coils 370, where the refrigerant is condensed. The excess heat produced by the compression is expelled through a vent 372 via the cooling fan 368. Then, the compressed refrigerant passes through the evaporator coil portion of coils 370, which is the portion of the coil that present in the upper front chamber 302 (i.e., the portion contained between the plates 303). As the liquid refrigerant evaporates, it absorbs heat thereby causing the cooling effect. The coils then return to the compressor and the process repeats itself to maintain a temperature below freezing (e.g. about −20 degrees Celsius or below) in the upper front chamber.

As shown in FIG. 6, the condenser 366, the fan 368, the condenser portion of the coil 370, and the vent 372 may all be disposed in the rear compartment 310. This arrangement separates the heat formed in the condenser portion of the coil 370 from entering the lower front compartment 304 or the upper front compartment 302, while providing a more compact design. Thus, when the first door 318 is closed, the upper front compartment 306 remains closed from heat or outside air. To assist in maintaining the proper temperature in the upper front compartment 302, a thermostat 364 may be implemented which detects the temperature of the compartment. The thermostat may report the temperature to a controller (not shown) that may control the cooling mechanism 338. For example, when the temperature detected by the thermostat rises above the desired temperature (e.g. above −20 degrees Celsius), the controller would turn on and the cooling mechanism 338 and when the detected temperature reaches a threshold value determined to be too far below freezing, the controller would turn the cooling mechanism 338. This control may be performed using methods known in the refrigeration art. To assist the efficiency of the cooling, each of the walls defining the upper front compartment 302 may be formed from an insulating material and/or have an insulating layer disposed thereon. For example, one or more, or all, of the dividing panel 312, the shaving plate 314, and the second dividing panel 316 may be formed of an insulating material and/or have an insulating layer disposed thereon.

The shaving mechanism 340 may include the shaving plate 314 and a blade 375 mounted thereon, which is best seen in FIG. 7. The shaving plate 314 may be the similar to the shaving plate 114 discussed above and shown in FIG. 3. This includes a similar blade 375 to the shaving blade 175 that may be mounted so that it extends through an opening 380 of the shaving plate 314, thereby contacting the ice block 334 resting on the shaving plate 314. However, because the lower front compartment 304 is open to ambient air on the front, the shave ice device 300 may further include a rotatable door 324 disposed underneath the shaving plate 314. The rotatable door 324 and shaving plate 314 are best seen in FIG. 7, which shows a bottom view looking up (i.e., the surface of the shaving plate 314 viewable in FIG. 7 faces the upper surface of the base plate 322). As shown in FIG. 7, in a first (closed) position (solid line rotatable door in FIG. 7), the rotatable door 324 is positioned to overlap with the blade 375 and the opening 376. In this first position the rotatable door 324 fully blocks and seals the pathway between the upper front compartment 302 and the lower front compartment 304. The rotatable door 324 may be made of an insulating material. When the rotatable door 324 is closed, communication between the upper front compartment 302 and the lower front compartment is blocked, thereby minimizing cold temperature loss in the upper front compartment 302. As shown in FIG. 7, in a second (open) position (dotted line), the rotatable door 324 may be pivoted about a pivot point 325, so that the opening 376 is exposed, thereby placing the upper front compartment 302 in communication with the lower front compartment 304. The rotatable door 324 may further include a handle 326 for gripping by an operator. Furthermore, the shaving plate 314 may include a detector 327, for example an electrical switch or sensor, which, when contacted by the rotatable door 324 signals to a controller (not shown) that the opening 376 is exposed. The rotatable door 324 may be spring loaded such that the spring biases the rotatable door 324 toward the first (closed) position when a force is not being applied to the rotatable door 324. This arrangement entirely avoids the need to refrigerate the lower front compartment 304 for the reasons described below.

Operation of shave ice device 300 is similar to the operation of the shave ice devices described. The machine operator (e.g., a customer) functions, however, may be different. In the shave ice device 300, instead of pressing a button that starts actuation of the rotatable mechanism 336, the machine operator grips the handle 326 with enough force to overcome the spring bias (if present) and pivots the rotatable door 326 about the pivot point 325 until the rotatable door contacts the detector 327 (e.g., a switch or a sensor). Once the detector 327 is contacted, a signal is sent to a controller, which in turn instructs the rotating mechanism 336 to operate. As long as the rotatable door 324 remains in contact with the detector 327 the rotating mechanism 336 will continue to operate, thereby dispensing shave ice into the lower front compartment 304. Once a desired amount of shave ice is collected in the lower front compartment 304, the machine operator may let go of the handle 326. As soon as the machine operator lets go of the handle 326, the spring will force the rotatable door 324 to move back toward the closed position and off of the detector 327. The controller then receives the signal that the rotatable door 324 is no longer open and stops the operation of the rotating mechanism 336. Alternatively, if no spring is present, the machine operator would need to manually return the rotatable door 324 to the closed position. Once closed, the upper front compartment 302 is once again sealed from communicating with the lower front compartment 304. The machine operator may then remove the plate containing the shaved ice from the lower front compartment 304.

Because the upper front compartment 302 is only in communication with the lower front compartment 304 at moments of dispensing, there is no need to refrigerate the lower front compartment 304. This saves significantly on energy and refrigeration costs. Second, the handle and rotatable door operation is desirable from a machine operator (e.g., customer) perspective because it is a similar operation to other self serve services machines that are already familiar with, such as ice cream and yogurt dispensing machines.

Figure 8:
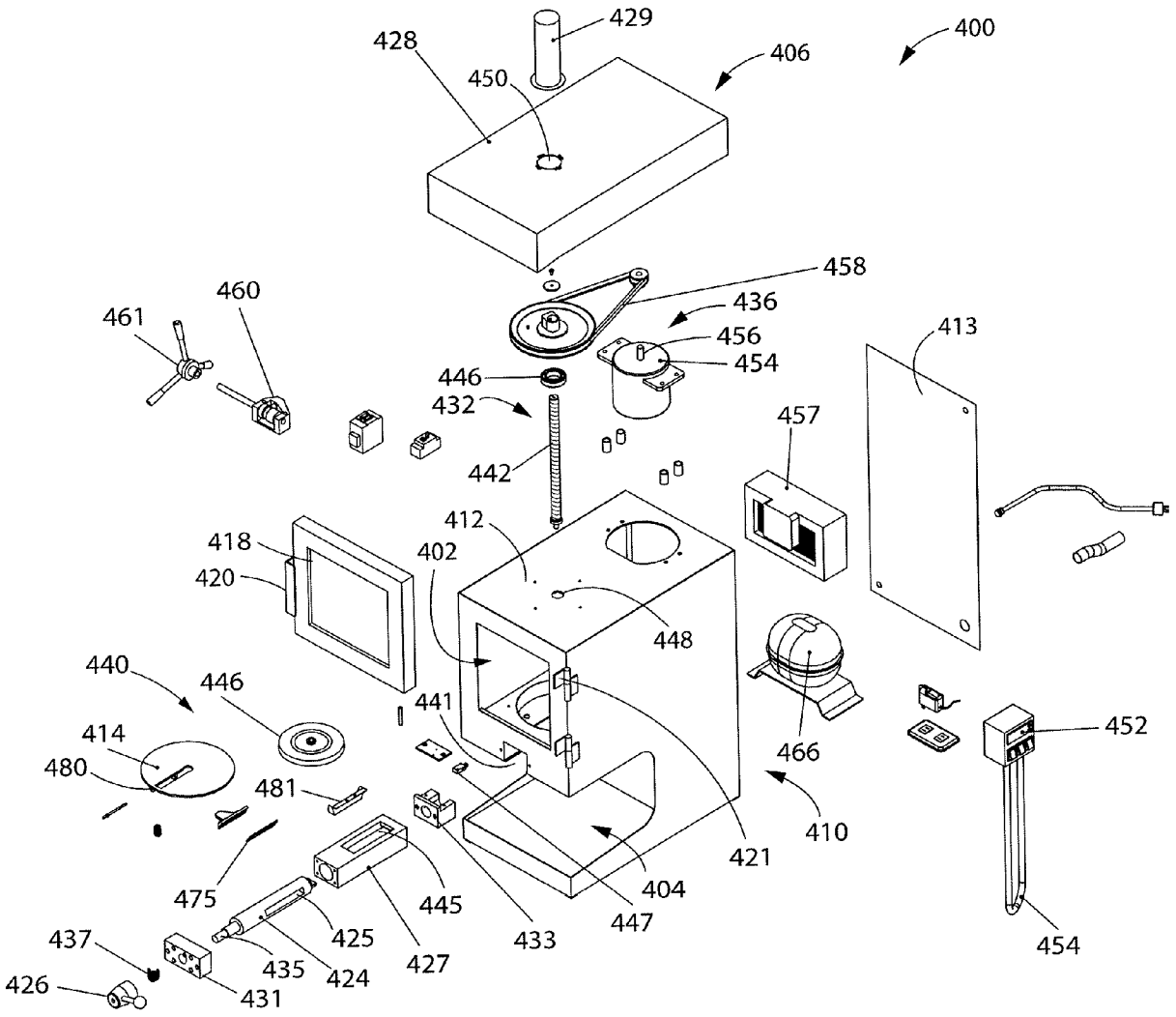
FIG. 8 is an exploded view of a shave ice device in accordance with aspects of the present invention.

FIG. 8 is an exploded view of a shave ice device 400 in accordance with other aspects of the present invention. The shave ice device 400 is similar to the shave ice devices 100, 200, 300 illustrated in FIGS. 2-7 and similar elements have similar reference numbers. One difference with the devices of FIGS. 2-7 is that the shave device 400, as compared to the shave device 300, includes an alternative structure to maintain freezing or below freezing temperature in the upper front compartment, as shown in FIG. 8, without having to maintain freezing or below freezing temperature in the lower front compartment, as shown in FIG. 8.

As shown in FIG. 8, the shave ice device 400 may include four compartments: an upper front compartment 402, a lower front compartment 404, a top compartment 406, and a rear compartment 410. The separation of the compartments in FIG. 8 is analogous to that for the shave ice device 300 shown in FIG. 6. For example, the upper front compartment 402 may be separated from the top compartment 406 by a first dividing panel 412, separated from the lower front compartment 404 by a shaving plate 414, and separated from the rear compartment 410 by a second dividing panel. The upper front compartment 402 may be separated from ambient air by a first door 418. The first door 418 may include an opening mechanism 420 (e.g., a handle) along with optional hinges 421 to allow the door to be opened by actuating the opening mechanism 420. Thus, when the first door 418 is closed, the upper front compartment 402 may be defined by the first dividing panel 412, the shaving plate 414, the second dividing panel, and the first door 418.

The lower front compartment 404 may be separated from the upper front compartment by the shaving plate 414 and may be separated from the rear compartment 410 by the second dividing panel. The lower front compartment 404 may be open to ambient air on the front side, as shown in FIG. 8, and be separated from ambient air on the lower side by a base plate. As a result, the lower front compartment 404 may be defined by the shaving plate 414, the second dividing panel, and the base plate.

The top compartment 406 may be separated from both the upper front compartment 402 and the rear compartment 410 by the first dividing panel 412. The top compartment 406 may otherwise be enclosed by a housing 428. Thus, the top compartment 406 may be defined by the housing 428 and the first dividing panel 412.

The rear compartment 410 may be separated from the top compartment 406 by the first dividing panel 412, separated from both the upper front compartment 302 and separated from the lower front compartment 404 by the second dividing panel. A portion of the base plate may also enclose a bottom portion of the rear compartment 410. The rear compartment 410 may thereby be defined by the first dividing panel 412, the second dividing panel, and the base plate. The rear compartment 410 may be open to ambient air on one side or may be closed by a rear panel 413.

The shave ice device 400 may further include a gripping mechanism 432 for gripping an ice block, a rotating mechanism 436 that rotates the gripping mechanism 432, a cooling mechanism, and a shaving mechanism 440 that shaves the ice block. The gripping mechanism 432 may include a shaft 442 having screw-like threading on the surface that extends substantially vertically (e.g., perpendicular to the shaving plate 414). A gripping plate 446 having gripping teeth extending toward the shaving plate 414 may be attached to an end of the shaft 442, closer to the shaving plate 414, as shown in FIG. 8. The other end of the shaft 442 may include a stopper 446. The end of the shaft 442 having the gripping plate 446 may be disposed in the upper front compartment, as shown in FIG. 8, and the shaft 442 may extend upwardly (e.g., in a direction away from the gripping plate 446, as shown in FIG. 8) though an orifice 448 formed in the first dividing panel 412, through the top compartment 406, and through an orifice 450 formed in the housing 428, such that a portion of the shaft, including the stopper 446, is external to the housing 428. The gripping mechanism 432 may further include an extendible sealing mechanism (which may be similar, for example, to the sealing mechanism shown in FIG. 6) surrounding a portion of the shaft 442 and attached on one end to the gripping plate 446 and on the other end to a surface of the dividing panel 412. The extendible sealing mechanism may seal the shaft 442 from the environment in the upper front compartment 402, thus, among other things, preventing condensation from forming on the shaft 442. The temperature of the upper front compartment 302 may be maintained at below freezing, which is discussed in more detail below. Further, the housing 428 may be sized to completely encompass the shaft 442 when the shaft 442 extends out of the housing 438, as the shaft cover 429 may be used to cover the portion of the shaft 442 extending out the housing 438.

The rotating mechanism 436 may be coupled with the shaft 442, such that, when operated, the rotating mechanism 436 rotates the shaft 442. The rotating mechanism 436 may include a motor 454, an output shaft 456 coupled to the motor 454, and a drive belt 458 coupled to the output shaft 456, which links rotational movement of the output shaft 456 to the shaft 442. The shave ice device 400 may further include an actuator 460 coupled with the shaft 442. The actuator 460 may be coupled with a handle 461 external to the house housing 428. The handle 461 may be coupled to the actuator 460, such that rotation of handle 461 raises the shaft 442 (e.g., to move away from the shaving plate 414) or lowers the shaft 442 (e.g. to move toward the shaving plate 414). In an aspect of the present invention, the actuator 460, belt 458, output shaft 456, and a portion of the motor 454 may be disposed within the top compartment 406, and a portion of the motor 454 may extend into the rear compartment 410. In another aspect of the present invention, the entire motor 454 may be disposed within the top compartment 406 (e.g., such that the entire rotating mechanism 436 is located within the top compartment 406). Accordingly, the rotating mechanism 436 may be disposed partly or entirely within the top compartment 406. The housing 428 may further include one or more vents 457 or one or more fans.

The cooling mechanism may include typical components of a freezer, such as may be found in a home refrigerator unit or air conditioner. For example, the cooling mechanism may include a compressor 466, a cooling fan, and coil. While only the compressor 466 is illustrated in FIG. 8, the compressor components may be configured in a similar manner to as discussed above with respect to FIG. 6. The coil tubing may pass through the upper front chamber 402, such as along coil plates disposed alongside the second dividing panel. Coil plates may also be disposed along all internal surfaces of the upper front chamber 402. While these features are not shown in FIG. 8, the components may be configured in a similar manner to as discussed above with respect to FIG. 6. However, the coil tubing/coil plate may not need to be present in the lower front chamber 404, for example, if the lower front chamber 404 is open to ambient air. The cooling mechanism may operate in a manner similar to the one discussed above. For example, refrigerant/coolant, such as FREON®, may be compressed in gas form into the condenser coil portion of the coils, where the refrigerant is condensed. The excess heat produced by the compression may be expelled through a vent via the cooling fan. Then, the compressed refrigerant may pass through the evaporator coil portion of the coils, which is the portion of the coil that is present in the upper front chamber 402, as shown in FIG. 8. As the liquid refrigerant evaporates, it absorbs heat, thereby causing a cooling effect. The coils then return to the compressor, and the process repeats itself to maintain a temperature below freezing (e.g. about −20 degrees Celsius or below) in the upper front chamber.

Similar to as discussed above with respect to FIG. 6, the condenser 466, the fan, the condenser portion of the coil, and the vent may all be disposed in the rear compartment 410. This arrangement prevents or retards heat formed in the condenser portion of the coil from entering the lower front compartment 404 or the upper front compartment 402, while providing a more compact design. Thus, when the first door 418 is closed, the upper front compartment 406 remains isolated from heat or outside air. To assist in maintaining the proper temperature in the upper front compartment 302, a thermostat may be used to detect the temperature of the compartment. The thermostat may report the temperature to a controller, which in turn may control the cooling mechanism. For example, when the temperature detected by the thermostat rises above the desired temperature (e.g. above about −20 degrees Celsius), the controller may activate the cooling mechanism, and when the detected temperature reaches a threshold value (e.g., determined to be sufficiently below freezing to stop the cooling function), the controller may turn off the cooling mechanism. This control may be performed using methods, systems, and devices known in the refrigeration art. To assist the efficiency of the cooling, each of the walls defining the upper front compartment 402 may be formed from an insulating material and/or have an insulating layer disposed thereon or therein. For example, one or more, or all, of the dividing panel 412, the shaving plate 414, and the second dividing panel may be formed of an insulating material and/or have an insulating layer disposed thereon or therein.

As shown in FIGS. 8 and 9, the shaving mechanism 440 may include the shaving plate 414 and a blade 475 mounted thereon. The shaving plate 414 may be the similar to the shaving plate 114 discussed in conjunction with and shown in FIG. 3. The variation of FIGS. 8 and 9 may include a similar blade 475 to the shaving blade 175 of FIG. 3, and which may be mounted so that it extends through an opening 480 of the shaving plate 414, thereby contacting the ice block resting on the shaving plate 414. As seen clearly in FIG. 9, the shaving mechanism 440 may also include a deflector 481 secured to an underside surface of the shaving plate 414. As shown in FIG. 9, the deflector 481 may shaped and positioned adjacent the opening 480 to guide the ice as it passes through the opening 480. The deflector 481 may have a general or partial U-shaped cross section, for example, as shown in FIG. 9.

Because the lower front compartment 404 is open to ambient air on the front, the shave ice device 400 may further include a rotatable door 424 disposed underneath the shaving plate 414. The rotatable door 424 for some implementations may serve as an alternative to the rotatable door described above in conjunction with FIG. 6. As shown in FIG. 8, the rotatable door 424 may operate, for example, via a rotatable shaft having an opening 425 that extends through the shaft and is sized and shaped to correspond with the opening 480 of the shaving plate 414. The rotatable door 424 may be rotatably mounted within a fixed mount 427. The fixed mount 427 may include an opening 445 corresponding to the shape of the opening 480 of the shaving plate 413 and the opening 425 of the rotatable door 424. The fixed mount 427 may be fixed within a receiving portion 441 below the shaving plate 414. The rotatable door 424 may supported on opposing ends by a front mount 431 and a rear mount 433. The front end 435 of the rotatable door may mate with a rotatable handle 426. The rotatable handle 426 may be rotatable about a longitudinal axis extending through the center of the rotatable door 424 (e.g., clockwise and counter clockwise, as shown in FIG. 8).

The rotatable door 424 may be rotatable between a first (closed) position and a second (open) position by rotating the handle 426. In the first (closed) position, the rotatable door 424 may be positioned such that the opening 425 of the rotatable door 424 is not aligned with the opening 445 of the fixed mount 427 or the opening 480 of the shaving plate 414. In this first position, the rotatable door 424 may fully block and seal the pathway between the upper front compartment 402 and the lower front compartment 404. The rotatable door 424 and the fixed mount 427 may comprise an insulating material. When the rotatable door 424 is closed, communication between the upper front compartment 402 and the lower front compartment may be blocked, thereby minimizing cold temperature loss in the upper front compartment 402. A bias mechanism 437 (e.g., a spring) may be coupled with the handle 426 and the rotatable door 424 to bias the rotatable door 424 to the closed position. This arrangement may help avoid the need to refrigerate the lower front compartment 404 for the reasons described below.

By rotating the handle 426 about the longitudinal axis of the rotatable door 424 sufficiently so as to overcome the biasing force of the bias member 437, the rotatable door 424 may be rotated into the open position. The rotatable door 424 may thereby be rotated until the opening 425 of the rotatable door 424 is aligned with the opening 445 of the fixed mount 427 and the opening 480 of the shaving plate 414, so as to place the upper front compartment 402 in communication with the lower front compartment 404. Furthermore, the shaving mechanism 440 may include an electrical detector 447, for example a switch or sensor, which, when contacted, signals to a controller (not shown) that the opening 480 is fully exposed (i.e., the rotatable door 424 is in the open position).

Operation of shave ice device 400 may be similar to the operation of the shave ice devices described above in FIGS. 2-7. The machine operator (e.g., a customer) functions, however, may differ. In the shave ice device 400, for example, instead of pressing a button that starts actuation of the rotating mechanism 436, the machine operator may grip the handle 426 with enough force to overcome the bias mechanism 437 (if present) and rotate the rotatable door 424 about its longitudinal axis until the detector 447 is contacted. Once the detector 447 is contacted, a signal may be sent to a controller, which in turn instructs the rotating mechanism 436 to operate. In another aspect, the detector may comprise a switch that, when contacted, directly begins actuation of the rotating mechanism. As long as the rotatable detector 447 is contacted, for example, the rotating mechanism 436 may continue to operate, thereby dispensing shave ice into the lower front compartment 404. Once a desired amount of shave ice is collected in the lower front compartment 404, the machine operator may release the handle 426. As soon as the machine operator releases the handle 426, the spring or other biasing element may force the rotatable door 424 to move back toward the closed position. The controller, upon receiving the signal that the switch 447 is no longer being contacted, may discontinue operation of the rotating mechanism 436. In another aspect, the detector may comprise a switch in which removal of contact with the switch directly causes the actuation of the rotating mechanism to cease. Alternatively, if no spring or other biasing mechanism is present, the machine operator may need to manually return the rotatable door 424 to the closed position for proper operation. Once closed, the upper front compartment 402 is again sealed from communicating with the lower front compartment 404. The machine operator may then remove the plate containing the shaved ice from the lower front compartment 404.

Because the upper front compartment 402 may only be in communication with the lower front compartment 404 during dispensing, there may be no need to refrigerate the lower front compartment 404. This approach may save significantly on energy and refrigeration costs. Second, the handle and rotatable door operation may be desirable from a machine operator (e.g., customer) perspective because it may be a similar in operation to other self serve services machines that the operator is already familiar with, such as ice cream and yogurt dispensing machines.

The shave ice device 400 may further include a moveable control panel 452 coupled to a flexible wire 454. The control panel may 452 include buttons for controlling various features of the machine, such as master power, lighting, cooling mechanism power, or any other suitable controls that are generally used by the owner/operator instead of the customer. The flexible wire 454 allows for versatility in where the control panel 452 may be placed. For example, the control panel 454 may be placed behind, on top of, on any side of, or in an entirely different room from the main body of the device. In another aspect, the control panel may operate wirelessly or be otherwise remotely operated. Function and uses for these types of controls (e.g., turning on the machine, setting the thermostat, etc., are discussed above with respect to FIGS. 2 and 4.

Figure 10A:
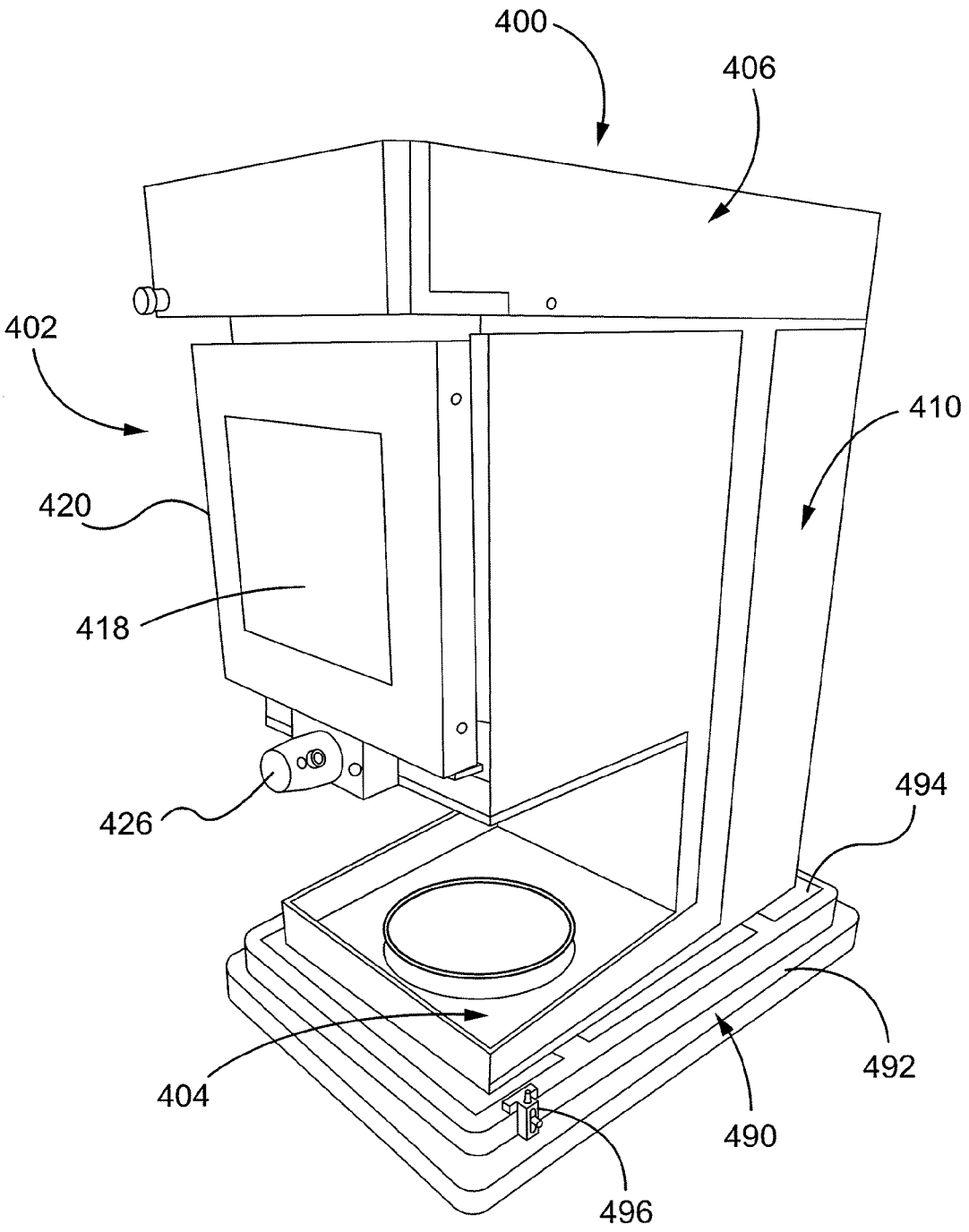
FIG. 10A is a perspective view of the shave ice device of FIG. 8 with turntable, in accordance with aspects of the present invention.
Figure 10B:
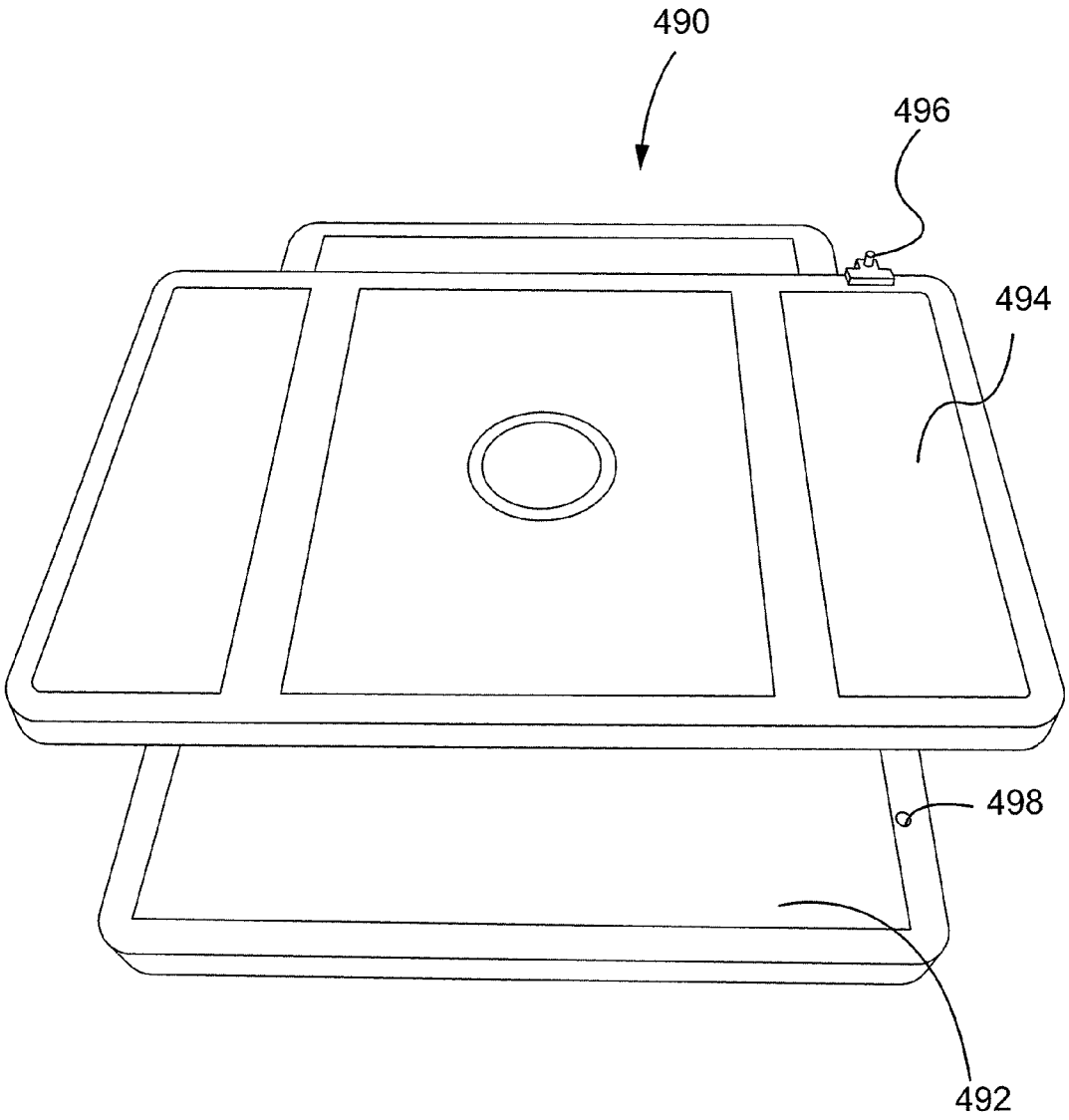
FIG. 10B is a top view of the turntable of FIG. 10A in a rotated orientation in accordance with aspects of the present invention.

As shown in FIG. 10A, the shave ice device 400 may further include a turntable 490. The turntable 490 may include a lower stationary element 492 and an upper rotatable element 494. As shown in FIG. 10A, the lower front compartment 402 may be mounted onto the rotatable element 494. The turntable 490 may include a securing element 496 that mates with a receiving opening 498. A pin of the securing element may be biased (e.g., by a spring) to mate with the receiving opening 498. In the locked position, shown in FIG. 10A, the securing element 496 may be mated with the receiving opening 498 via the pin. Rotating the rotatable element 494 in this state would be resisted because of the mating of the pin of the securing element 496. In order to rotate the rotatable element 494, the operator may apply a force on the pin opposing biasing force, for example, to remove the mating of the pin of the securing element 496 with the receiving opening 498. Once unmated, the operator may rotate the rotatable element 494 relative to the stationary element 492, about a vertical axis. FIG. 10B shows the rotatable element 494 rotated approximately 90 degrees relative to the stationary element 496. The rotatable element 494 may be further rotated, including rotation 180, 270, or 360 degrees, for example. Once the securing element 496 returns to the receiving opening 498 position, the spring or other biasing element may cause the securing element 496 to automatically mate with the receiving opening 498 via the pin, thereby returning to the locked position.

The turntable 490 may be particularly useful in a self-serve environment, where the dispensing side of the matching must face the customer. It is common in self-serve establishments for the user to have access to the front of the machine, and the owner/operator to have access to the rear of the machine. Machines may typically be built into a wall or structure in which the rear of the machine is only accessible to the owner/operator. The turntable 490 may thus be used, for example, to easily replace an ice block without needing to do so in the way of the customer. Once a new ice block needs to be inserted, the owner/operator may rotate the rotatable element 494 in the manner described above, until the front of the machine faces the owner on the other side of the structure. The owner/operator may then add a new ice block and then rotate the rotatable element 494 again until the dispensing side once again faces the customer.

In another aspect of the present invention, instead of using a turntable, the shave ice device may be configured such that the upper front compartment faces the opposite direction from the dispensing side of the front lower compartment. As a result, instead of the door of the front upper compartment opening on the side of the device where the customer operates the handle, the front upper compartment may open on the opposite side. Among other things, this arrangement allows for the owner/operator to add a new ice block without the need for rotating.

Several of the features discussed above with respect to the shave ice devices 100, 200 of FIGS. 2-4 are also applicable to the shave ice device 300 of FIGS. 6 and 7 and the shave ice device 400 of FIG. 8. The power timer 282 may be used in a similar manner to prepare the temperature of the upper front compartment 302, 402. The thermostat 284 may be used to set the temperature of the upper front compartment 302, 402. The lighting 298, coils 296 and panel 292 may be used for the upper front compartment 302, 402. All non-mutually exclusive features discussed above with respect to the shave ice devices 100, 200 of FIGS. 2-4 may be used in the shave device 300 of FIGS. 6 and 7 and the shave device 400 of FIG. 8, and vice versa.

While the rotating door has been described above with respect to a manual operation in the shave ice device 300 of FIGS. 6 and 7, the rotating door aspect can also be implemented in the shave ice devices 100, 200 illustrated in FIGS. 2-4. Specifically, a rotating door can be implemented in the shave ice devices 100, 200 in a similar manner as described with respect to FIGS. 6 and 7, thereby avoiding the need to maintain the lower front compartments 104, 204 during operation of the those deices. This modified version of the shave ice devices 100, 200 would still operate in a manner similar to the one described above (i.e., with the buttons, timers, etc), except that in addition to the start button 288 controlling the start of the rotating mechanism 136, 236, the start button 288 would also cause the rotatable door to rotate in a similar manner described above with respect to FIGS. 6 and 7. This aspect of the invention would not require a handle on the door because the controls are performed via the start button. All non-mutually exclusive features discussed above with respect to the shave ice device 300 of FIGS. 6 and 7 can be implemented in the shave ice devices 100, 200 of FIGS. 2-4.

While the deflector 481 has been shown and described with respect to the shave ice device 400, it should be understood that a similar deflector may be included in a similar manner in any of shave ice devices 100, 200, 300.

While the turntable 490 has been shown and described with respect to the shave ice device 400, it should be understood that a similar turntable may be included in a similar manner in any of shave ice devices 100, 200, 300. Similarly, instead of a turntable, any of the shave ice devices 100, 200, 300 may have the upper front compartment 102, 202, 302 open in the opposite direction as the lower front compartment 104, 204, 304 to avoid the need for the turntable.

While the control panel 452 coupled to a flexible wire 454 has been shown and described with respect to the shave ice device 400, it should be understood that a similar control panel 452 and flexible wire 454 may be implanted in any of the shave ice devices 100, 200, 300.

In another aspect of the present invention, the shaving plates 114, 214, 314, 414 may have one or more additional blades mounted thereon. For example, a second blade and second blade opening may be positioned 180 degrees from the blades 175, 275, 475 shown in FIGS. 3,7, and 9. If three blades are present they would be radially mounted every 120 degrees. Four blades would be mounted every 90 degrees, etc. Even distribution of blades along with respective openings allows for more even distribution on the plate collecting the shave ice. In another aspect of the present invention, in addition to or as an alternative to multiple blades, distribution can be improved by rotating the plate that receives the shaved ice. This can be achieved by installing a rotating member that the shave ice receiving plate sits on. During dispensing, the rotating member will rotate, thereby rotating the shave ice receiving plate. The rotation of the rotation member can be electronically tied to the start button 288 or the switch/sensor 327 such that the rotating member rotates when the start button 288 is pressed on the switch/sensor 327 is contacted. Alternatively, a distinct rotation button may be implemented such that pressing the button rotates the rotating member independent of the state of dispensing. The rotation button may be pressure sensitive so that harder depression of the button causes the rotating member to rotate faster, for example.

The above described shave ice devices and methods of operation provide many advantages of the conventional ice shave machines. The upper front compartment allows for easy exchange of a spent ice block for a fresh ice block. Sealed insulated compartments minimize energy usage. Transparent panels allow for quick visual monitoring of the ice block status. The rotating mechanism being separated from the refrigerated compartments allows the rotating mechanism to maintain lubrication and prevent malfunction and corrosion. The devices are machine operator friendly and allow a machine operator to intuitively operate the device to shave their own ice. All of the above-described downsides of having to manually replace an ice block every time a shave ice is ordered is entirely avoided.

While multiple aspects have been disclosed above, it should be noted that all non-mutually exclusive features may implemented in any of the other variations.

The previous description is provided to enable any person skilled in the art to practice the various aspects described herein. Various modifications to these variations will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

The invention claimed is:

1. A shave ice device, comprising:

a first compartment;

a second compartment below the first compartment;

a gripping mechanism for gripping a block of ice;

a rotating mechanism for rotating the gripping mechanism;

a shaving plate separating the first compartment from the second compartment, the shaving plate having a blade coupled thereto; and a cooling mechanism in communication with the first compartment such that the cooling mechanism maintains the temperature of the first compartment at about 0 degrees Celsius or lower, wherein the gripping mechanism comprises a shaft with an adjustable length extending in a direction perpendicular to the shaving plate.

2. The shave ice device of claim 1, wherein the second compartment is coupled with the cooling mechanism, and wherein the cooling mechanism maintains the temperature of the second compartment at about 0 degrees Celsius or lower.

3. The shave ice device of claim 2, further comprising a door enclosing a front side of the second compartment.

4. The shave ice device of claim 1, further comprising a button, wherein the rotating mechanism is configured to actuate when the button is pressed.

5. The shave ice device of claim 4, wherein the rotating mechanism is configured to terminate actuation when the button is not pressed.

6. The shave ice device of claim 4, further comprising a dispensing timer, wherein the rotating mechanism is configured to terminate actuation when dispensing timer reaches zero.

7. The shave ice device of claim 3, wherein the door comprises a transparent panel;

wherein shave ice device further comprising a defrosting mechanism configured to defrost the transparent panel.

8. The shave ice device of claim 1, further comprising a turntable configured to provide rotation of the ice shaving device relative to a surface on which the ice shaving device is mounted.

9. The shave device of claim 8, wherein the turntable comprises a rotatable element and a stationary element, and wherein the rotatable element is rotatable up to 360 degrees relative to the stationary element.

10. The shave ice device of claim 1, wherein the second compartment is in communication with ambient air.

11. The shave ice device of claim 1, further comprising a third compartment adjacent the first compartment, wherein a portion of the gripping mechanism and a portion of the rotating mechanism are disposed within the third compartment.

12. The shave ice device of claim 11, further comprising a fourth compartment adjacent the second compartment, wherein a portion of the cooling mechanism is disposed within the fourth compartment.

13. The shave ice device of claim 1, further comprising a door enclosing a front side of the first compartment.

14. The shave ice device of claim 1, wherein the shaving plate comprises an opening, wherein the blade extends into the opening of the shaving plate; and a door disposed below the shaving plate, and wherein the door is configured to rotate from a position covering the opening of the shaving plate to a position uncovering the opening of the shaving plate.

15. The shave ice device of claim 14, wherein the door comprises an opening, and wherein in the position uncovering the opening of the shaving plate, the opening of the door is aligned with the opening of the shaving plate.

16. The shave ice device of claim 14, further comprising a handle coupled with the door such that rotation of the handle rotates the door.

17. The shave ice device of claim 14, further comprising:

a detector configured to detect whether the door is in the uncovered position; and wherein the rotating mechanism is configured to actuate when the detector detects that the door is in the uncovered position.

18. The shave ice device of claim 17, further comprising:

a bias mechanism configured to bias the door toward the covered position, wherein the rotating mechanism is configured to terminate actuation when the detector detects that the door is in not in the uncovered position.

19. The shave ice device of claim 17, wherein the detector comprises a switch, and wherein contacting the switch actuates the rotating mechanism.

20. The shave ice device of claim 1, wherein the shaving plate comprises an opening, wherein the blade extends into the opening of the shaving plate; and a deflector coupled with shaving plate adjacent the opening.

* * * * *